US011583032B2

(12) United States Patent
Weast et al.

(10) Patent No.: US 11,583,032 B2
(45) Date of Patent: Feb. 21, 2023

(54) ARTICLES OF FOOTWEAR WITH ADAPTIVE-HEIGHT BLADDER ELEMENTS

(71) Applicant: NIKE, Inc., Beaverton, OR (US)

(72) Inventors: Aaron B. Weast, Portland, OR (US); Peter P. Williams, II, Portland, OR (US); Alexander S. Siegel, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 250 days.

(21) Appl. No.: 16/888,529

(22) Filed: May 29, 2020

(65) Prior Publication Data

US 2020/0375310 A1 Dec. 3, 2020

Related U.S. Application Data

(60) Provisional application No. 62/855,735, filed on May 31, 2019.

(51) Int. Cl.

| | |
|---|---|
| ***A43B 13/20*** | (2006.01) |
| ***A43B 5/06*** | (2022.01) |
| ***A43B 13/18*** | (2006.01) |

(52) U.S. Cl.

CPC ..... *A43B 13/203* (2013.01); *A43B 5/06* (2013.01); *A43B 13/206* (2013.01); *A43B 13/187* (2013.01)

(58) Field of Classification Search

None

See application file for complete search history.

(56) References Cited

U.S. PATENT DOCUMENTS

| | | | | |
|---|---|---|---|---|
| 2012/0291564 | A1* | 11/2012 | Amos | A43B 13/141 73/862.041 |
| 2013/0278436 | A1 | 10/2013 | Ellis | |
| 2016/0058123 | A1* | 3/2016 | Peyton | A43B 13/141 36/25 R |
| 2016/0345670 | A1* | 12/2016 | Orand | A43B 7/144 |
| 2017/0071287 | A1 | 3/2017 | Kim | |
| 2017/0150785 | A1* | 6/2017 | Walker | A43B 3/34 |
| 2017/0347747 | A1* | 12/2017 | Groeneweg | A43B 23/0275 |
| 2018/0035752 | A1* | 2/2018 | Walker | A43B 3/34 |
| 2018/0263532 | A1* | 9/2018 | Smulyan | A43B 17/00 |
| 2019/0000182 | A1 | 1/2019 | Grand | |
| 2019/0059511 | A1* | 2/2019 | Walker | A43B 5/06 |
| 2019/0110551 | A1 | 4/2019 | Walker | |

FOREIGN PATENT DOCUMENTS

WO WO 2016/196077 A1 12/2016

OTHER PUBLICATIONS

International Search Report and Written Opinion, dated Sep. 22, 2020, issued for International Patent Application No. PCT/US2020/035252, 15 pages.

* cited by examiner

*Primary Examiner* — Jameson D Collier
*Assistant Examiner* — Matthew R Marchewka
(74) *Attorney, Agent, or Firm* — Klarquist Sparkman, LLP

(57) ABSTRACT

Articles of footwear can include an adaptive-height sole structure that includes a variable height bladder system. The sole structure can include one or more bladder systems positioned between a midsole and a banking plate. The banking plate can change its relative orientation to the midsole based on an inflation level of the bladder systems.

19 Claims, 19 Drawing Sheets

ARTICLES OF FOOTWEAR WITH ADAPTIVE-HEIGHT BLADDER ELEMENTS

CROSS REFERENCE TO RELATED APPLICATION

This application claims the benefit of U.S. Provisional Application No. 62/855,735, filed May 31, 2019. The prior application is incorporated herein by reference in its entirety.

FIELD

This disclosure is directed to support systems in articles of footwear and, more particularly, to sole structures with adaptive, fluid-receiving bladder elements.

BACKGROUND

Articles of footwear can include sole structures with support systems that enhance the performance of the article and/or the comfort of the wearer. Continued improvements in support systems for articles of footwear are desirable.

DETAILED DESCRIPTION

General Considerations

Figure 1:
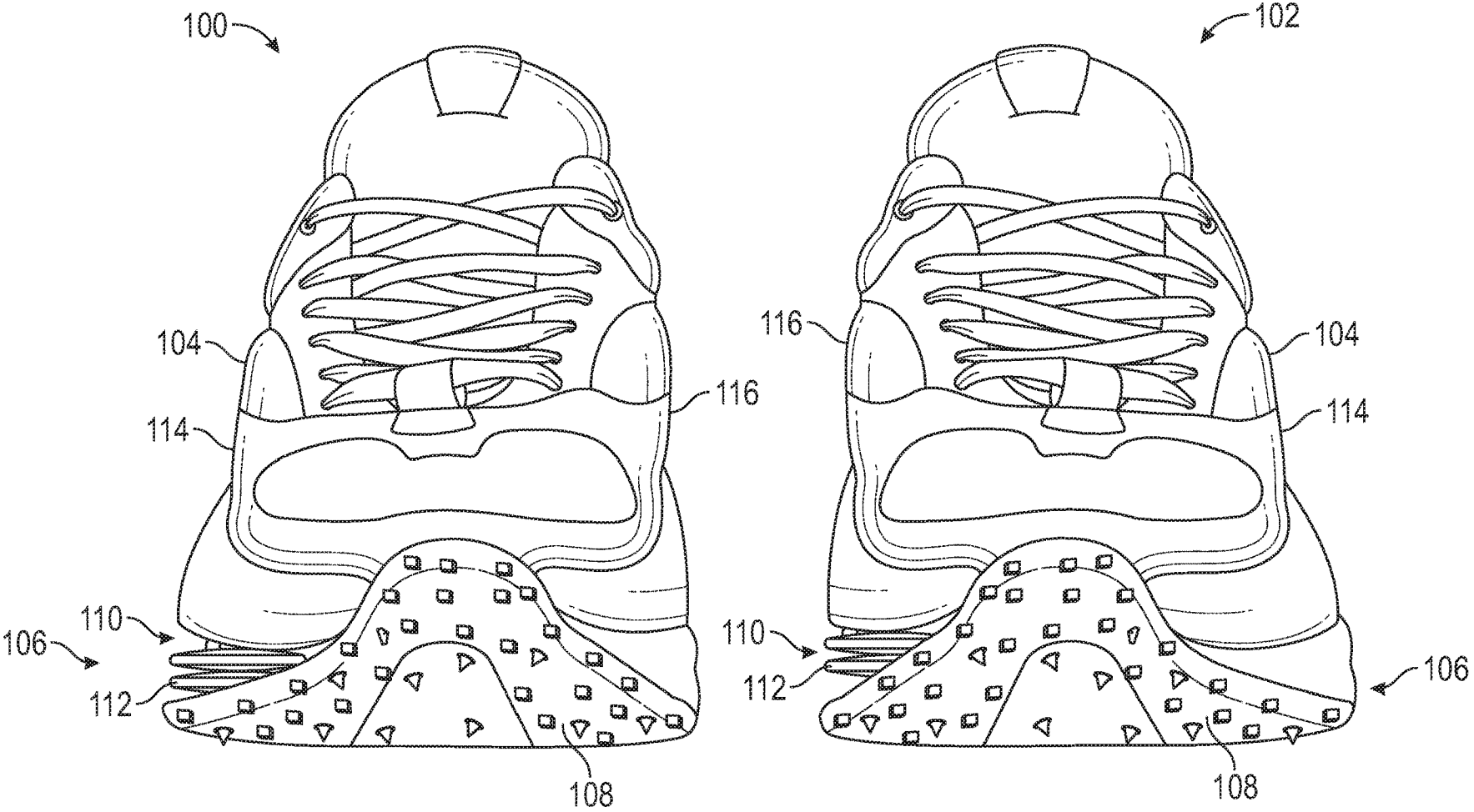
FIG. 1 illustrates an exemplary pair of shoes that incorporate adaptive, fluid-filled bladder elements.

The systems and methods described herein, and individual components thereof, should not be construed as being limited to the particular uses or systems described herein in any way. Instead, this disclosure is directed toward all novel and non-obvious features and aspects of the various disclosed embodiments, alone and in various combinations and subcombinations with one another. For example, any features or aspects of the disclosed embodiments can be used in various combinations and subcombinations with one another, as will be recognized by an ordinarily skilled artisan in the relevant field(s) in view of the information disclosed herein. In addition, the disclosed systems, methods, and components thereof are not limited to any specific aspect or feature or combinations thereof, nor do the disclosed things and methods require that any one or more specific advantages be present or problems be solved.

As used in this application the singular forms "a," "an," and "the" include the plural forms unless the context clearly dictates otherwise. Additionally, the term "includes" means "comprises." Further, the term "coupled" or "secured" encompasses mechanical and chemical couplings, as well as other practical ways of coupling or linking items together, and does not exclude the presence of intermediate elements between the coupled items unless otherwise indicated, such as by referring to elements, or surfaces thereof, being "directly" coupled or secured. Furthermore, as used herein, the term "and/or" means any one item or combination of items in the phrase.

As used herein, the term "exemplary" means serving as a non-limiting example, instance, or illustration. As used herein, the terms "e.g.," and "for example," introduce a list of one or more non-limiting embodiments, examples, instances, and/or illustrations.

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed things and methods can be used in conjunction with other things and methods. Additionally, the description sometimes uses terms like "provide," "produce," "determine," and "select" to describe the disclosed methods. These terms are high-level descriptions of the actual operations that are performed. The actual operations that correspond to these terms will vary depending on the particular implementation and are readily discernible by one of ordinary skill in the art having the benefit of this disclosure.

As used herein, the directional terms (e.g., "upper" and "lower") generally correspond to the orientation of an article of footwear or sole structure as it is configured to be worn by a wearer. For example, an "upwardly-facing surface" and/or an "upper surface" of a sole structure refers to the surface oriented in the "superior" anatomical direction (i.e., toward the head of a wearer) when the article of footwear is being worn by the wearer. Similarly, the directional terms "downwardly" and/or "lower" refer to the anatomical direction "inferior" (i.e., toward the ground and away from the head of the wearer). "Front" means "anterior" (e.g., towards the toes), and "rear" means "posterior" (e.g., towards the heel). "Medial" means "toward the midline of the body," and "lateral" means "away from the midline of the body."

As used herein, the term "banking angle" means an angle at which a surface of a sole structure is inclined about its longitudinal axis with respect to the horizontal. If the banking angle is zero, for example, the sole structure is generally flat. For the purposes of this application, the banking angle of an article of footwear is the angle between a surface of the sole structure and the ground where the angle is greatest along the length of the article of footwear.

Unless explained otherwise, all technical and scientific terms used herein have the same meaning as commonly understood to one of ordinary skill in the art to which this disclosure belongs. Although methods and materials similar or equivalent to those described herein can be used in the practice or testing of the present disclosure, suitable methods and materials are described below. The materials, methods, and examples are illustrative only and not intended to be limiting. Other features of the disclosure are apparent from the detailed description, claims, abstract, and drawings

The Disclosed Technology

Various sole structures and articles of footwear that include adaptive support systems, as well as methods of manufacturing the same, are disclosed herein.

In some embodiments, articles of footwear are provided that include an upper and an adaptive-height sole structure. The sole structure can comprise a midsole secured to the upper, an anchor plate having at least one projection secured to at least a portion of the midsole, a banking plate having at least one aperture and positioned between the midsole and the anchor plate, and at least one bladder system disposed between the midsole and the banking plate and configured to receive a fluid in at least one cavity therein. The bladder system(s) can be secured to a bottom surface of the midsole and a top surface of the banking plate and increasing the amount of the fluid in the at least one bladder system changes the at least one bladder system from an uninflated state to an inflated state. In addition, the banking plate and the midsole can have a first relative orientation when the at least one bladder system is in the uninflated state and a second, different relative orientation when the at least one bladder system is in the inflated state.

The articles can also include a fluid control system that can adjust an amount of inflation of the at least one bladder system. The fluid control system can comprise at least one reservoir, at least one fluid line extending from the at least one reservoir to the at least one bladder system, and at least one valve positioned between the at least one reservoir and the at least one bladder system. The valve(s) can have a closed position in which the fluid is prevented from flowing between the at least one reservoir and the at least one bladder system, and an open position in which the fluid can flow between the at least one reservoir and the at least one bladder system.

In some embodiments, the bladder system(s) can be positioned on a lateral side or a medial side of the article of footwear, and a banking angle can be formed between the banking plate and the anchor plate when the at least one bladder system is in the inflated state. The article of footwear can be a right article of a pair of articles of footwear with the bladder system(s) on the lateral side of the right article, or a left article with the bladder system(s) positioned on the medial side of the left article.

The banking plate can be secured to the midsole at a heel region of the article of footwear to restrict movement between the midsole and the banking plate, and the bladder system(s) can be positioned in a forefoot region and/or a midfoot region of the article of footwear so that the banking plate is moveable relative to the midsole in the forefoot region and/or midfoot region.

Various methods for manufacturing sole structures as disclosed herein are also disclosed. In one embodiment, the method includes forming a midsole, a banking plate with at least one aperture, and an anchor plate with at least one projections. The banking plate can be positioned between the midsole and the anchor plate with the at least one projection extending through the at least one aperture and the anchor plate can be secured to the midsole. At least one bladder system can be positioned between the midsole and the banking plate. The bladder system(s) can be configured to receive and discharge a fluid, such that the at least one bladder system is inflatable and deflatable to increase or decrease a height of the bladder system(s). The bladder system(s) can be secured to a lower surface of the midsole and an upper surface of the banking plate.

In some embodiments, the at least one bladder system is secured to the midsole and banking plate on a lateral or medial side of the sole structure, such that a banking angle is formed between the banking plate and the anchor plate when the at least one bladder system is in the inflated state.

These embodiments and others are described in detail below.

Exemplary Embodiments of Sole Structures and Articles of Footwear

Articles of footwear (also referred to herein as "articles") can include running shoes, soccer shoes, football shoes, rugby shoes, basketball shoes, baseball shoes, tennis shoes, sneakers, boots, sandals, dress shoes, work shoes, and any other type of footwear to which the support systems disclosed herein may be applied. Articles of footwear typically include a sole structure, also referred to as a sole structure herein, and an upper coupled to the sole structure. The upper forms an interior void configured to receive a foot of a wearer. The articles of footwear described herein have sole structures that include adaptive support systems that can vary one or more of the angle, curvature, orientation, and/or shape of a supporting surface on which a wearer's foot is received.

Figure 2:
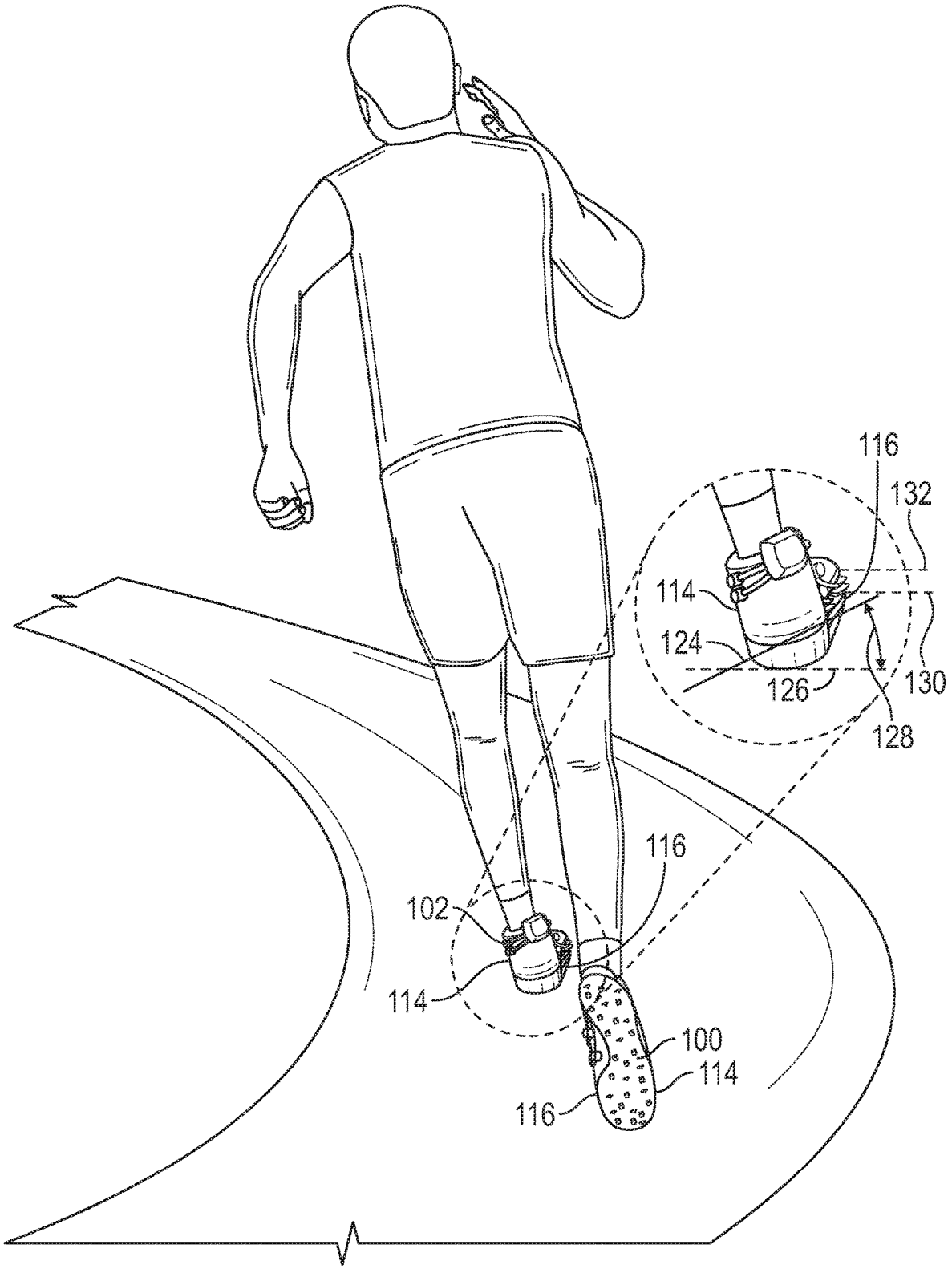
FIG. 2 illustrates an exemplary view of a runner wearing an exemplary pair of shoes that incorporate adaptive, fluid-filled bladder elements.

FIGS. 1-3 illustrate a right article of footwear 100 and a left article of footwear 102. Each has an upper 104 coupled to a sole structure 106. Each sole structure 106 includes an outsole 108 and an adaptive-height midsole structure 110 with a bladder system 112.

Portions of the sole structure and the corresponding article of footwear may be identified based on regions of the foot located at or near that portion of the article of footwear when the footwear is worn on the properly sized foot. For example, footwear and/or sole structures include a lateral side 114 (the "outside" or "little toe side" of the foot) and a medial side 116 (the "inside" or "big toe side" of the foot). The lateral and medial sides of the footwear extend through the forefoot, midfoot, and heel regions and generally correspond with opposite sides of the footwear (and may be considered as being separated by a central longitudinal axis LA).

Figure 5:
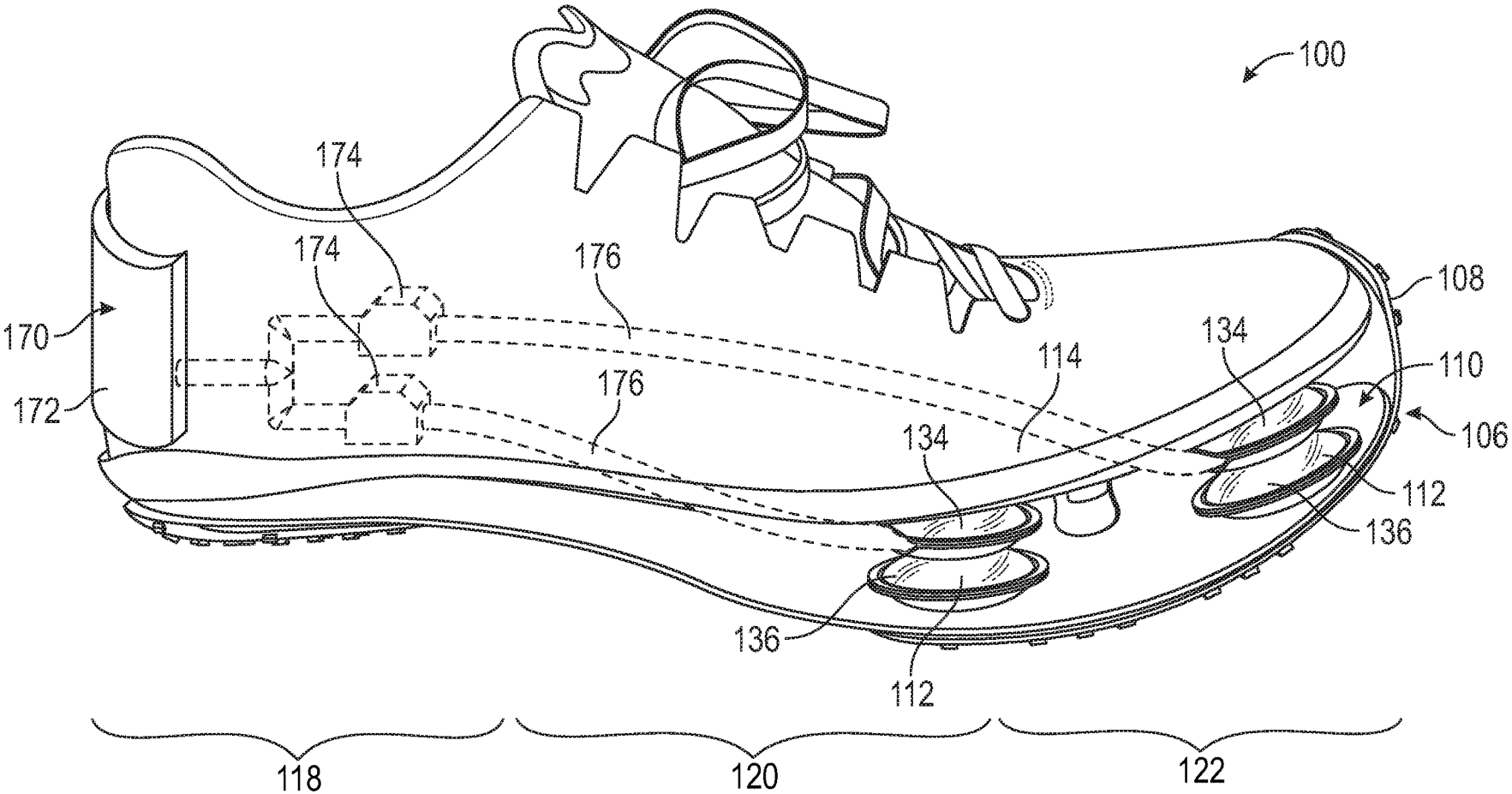
FIG. 5 illustrates a lateral side view of an exemplary right article of footwear that incorporate adaptive, fluid-filled bladder elements.

In addition, as shown in FIG. 5, an article of footwear and/or a sole structure may be considered as having a heel region 118 at the rear of the foot, a midfoot region 120 at the middle or arch area of the foot, and a forefoot region 122 at the front of the foot. Heel region 118 is generally associated with the heel of a foot, including the calcaneus bone, midfoot region 120 is generally associated with the arch of a foot, and forefoot region 122 is generally associated with the toes and joints connecting the metatarsals with the phalanges.

Sole structures 106 can be configured to provide traction for the articles of footwear, as well as provide support structure that supports the foot of a wearer during walking, running or other ambulatory activities. The configuration of sole structures 106 can vary based on use, including the type of ground surfaces on which the sole structures 106 are intended to be used (e.g., road surfaces, track surfaces, natural turf, synthetic turf, dirt, and other surfaces).

As discussed above, the sole structures described herein comprise an adaptive-height midsole structure that can vary the support structure of the sole structure to provide an article of footwear that supports the wearer's foot in a manner that can vary an angle, curvature, orientation, and/or shape of the surface receiving the wearer's foot. In this manner, the support structure can adapt or change to provide improved performance and/or comfort in situations where a non-flat orientation of the wearer's foot is desirable.

In some embodiments, the adaptive-height midsole structure can provide improved banking (e.g., turning) performance when the wearer is turning while walking or running on a track, such as when running counterclockwise on a curved portion of a track as shown in FIG. 2. The adaptive-height midsole structure can adjust a banking angle of the sole structure 106 of the articles of footwear by increasing a height of at least a portion of the sole structure on one side of the article. As shown in FIG. 2, an upper surface 124 of sole structure 106 is inclined about its longitudinal axis with respect to a horizontal plane 126 to provide a banking angle 128. To achieve this banking angle, a portion of the medial side of the left article 102 is increased in height from a first height 130 to a second height 132.

To provide the banking angle and associated height variation relative to a ground surface shown in FIG. 2, the bladder system 112 of the right article 100 is positioned on the lateral side 114 and the bladder system 112 of the left article 102 is position on the medial side 116 as shown in FIG. 1.

FIGS. 3A-3C and FIGS. 4A-4C show a changing banking angle 128 on the right article 100 and left article 102, respectively. As shown in these figures, the banking angle 128 is increased as the bladder system 112 inflates to increase a height of sole structure (and, in turn, the foot within the article of footwear) from a first height 130 in which the bladder system is not inflated to a second height 132 in which the bladder system is at least partially inflated.

The bladder systems disclosed herein can be inflated by any suitable fluid, including a gas (such as air, an inert gas such as nitrogen, or other suitable gases), liquid (such as water, oil, or other suitable liquids), or a combination thereof.

Figure 3A:
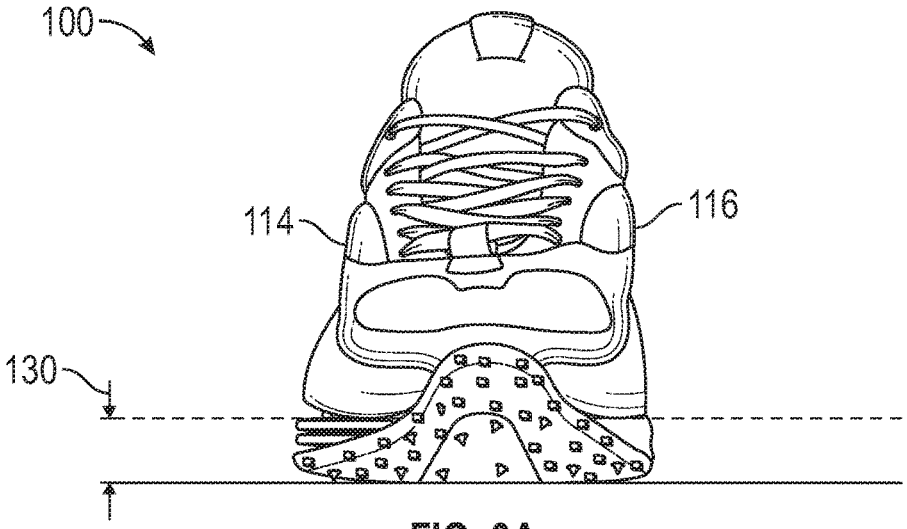
FIGS. 3A-3C illustrate a right article of footwear in various states of inflation.
Figure 4A:
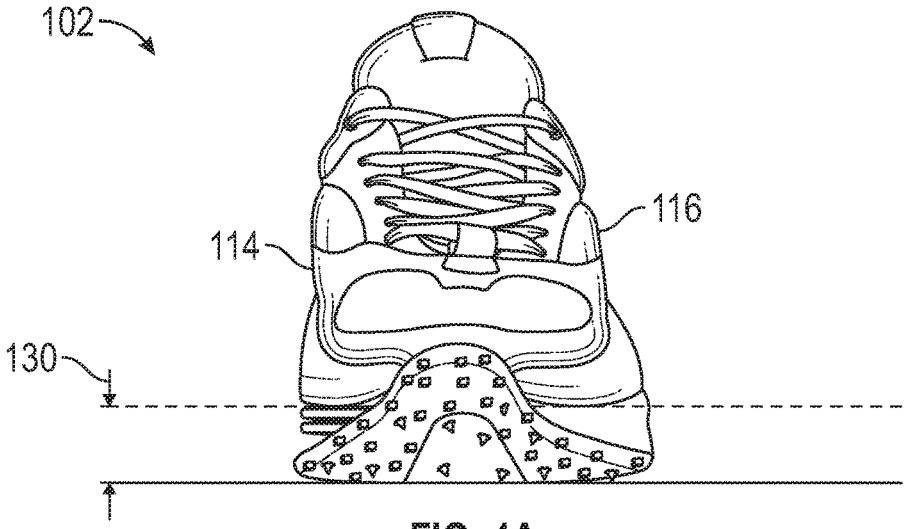
FIGS. 4A-4C illustrate a left article of footwear in various states of inflation.

In FIGS. 3A and 4A, the bladder systems 112 are shown in an uninflated state. As used herein, the term "uninflated state" refers to a state in which the bladder system is in an uninflated or minimally-inflated condition. In the uninflated state, the sole structure has its minimum banking angle 128, which in some embodiments will be approximately zero.

Figure 3B:
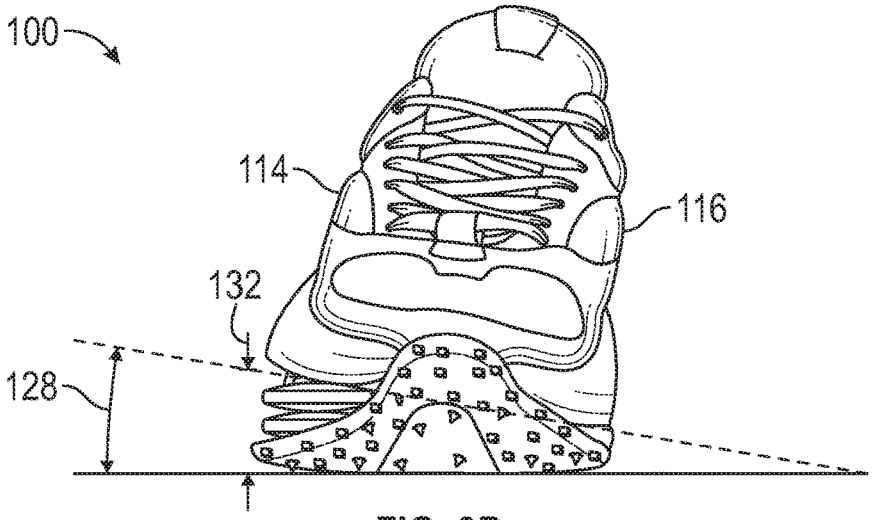
Figure 3C:
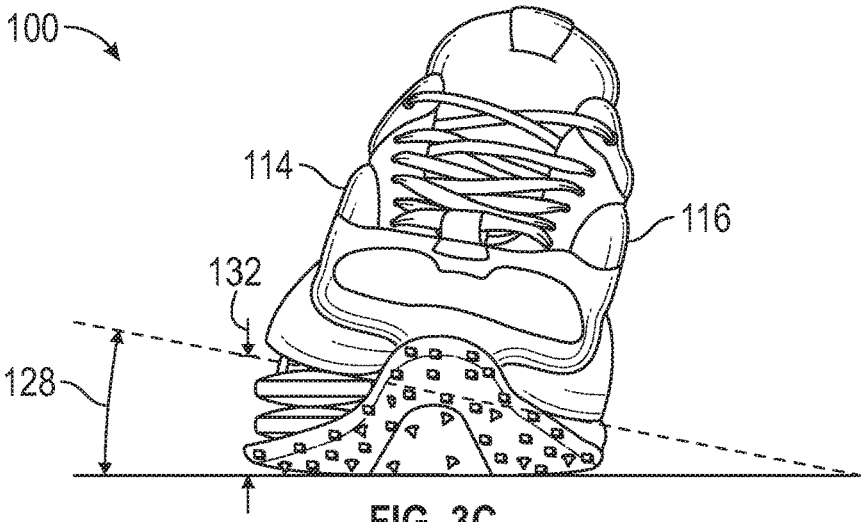
Figure 4B:
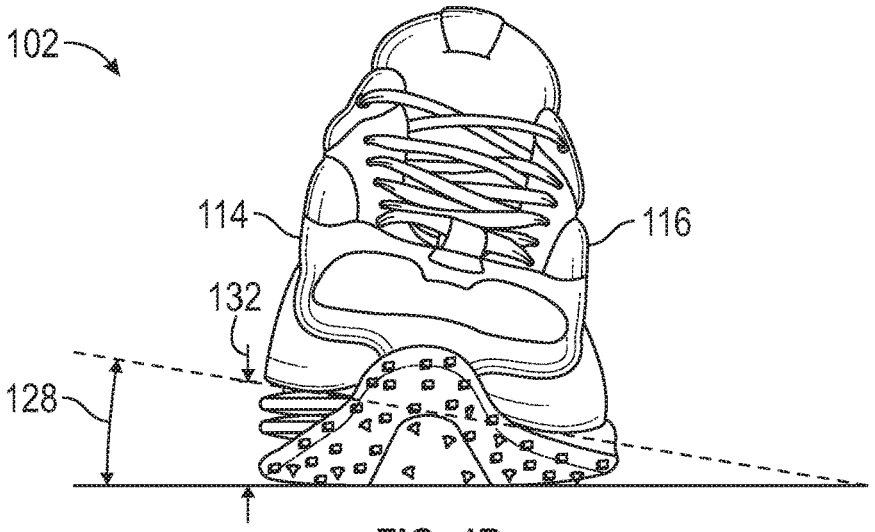
Figure 4C:
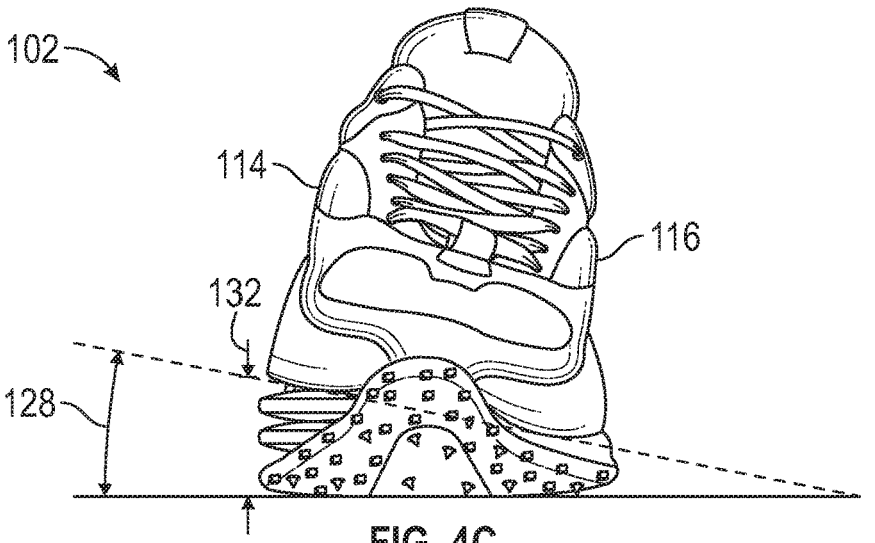

FIGS. 3B and 4B illustrate the bladder systems 112 in an inflated condition with a non-zero banking angle 128, and FIGS. 3C and 4C illustrate the bladder systems 112 after undergoing further inflation which generates an even greater banking angle 128 than that shown in FIGS. 3B and 4B.

The desired banking angle can vary depending on application. For example, with a maximum banking angle of 20 degrees, the desired banking angle would be able to vary between 0 and 20 degrees. In other embodiments, higher maximum banking angles can be achieved (e.g., 30 degrees). In other embodiments, lower maximum banking angles can be provided such as 18 degrees, 15 degrees, and 10 degrees. Thus, for example, in these embodiments, the banking angle of an article of footwear can vary between 0 and 18 degrees, between 0 and 15 degrees, and between 0 and 10 degrees.

Figure 6:
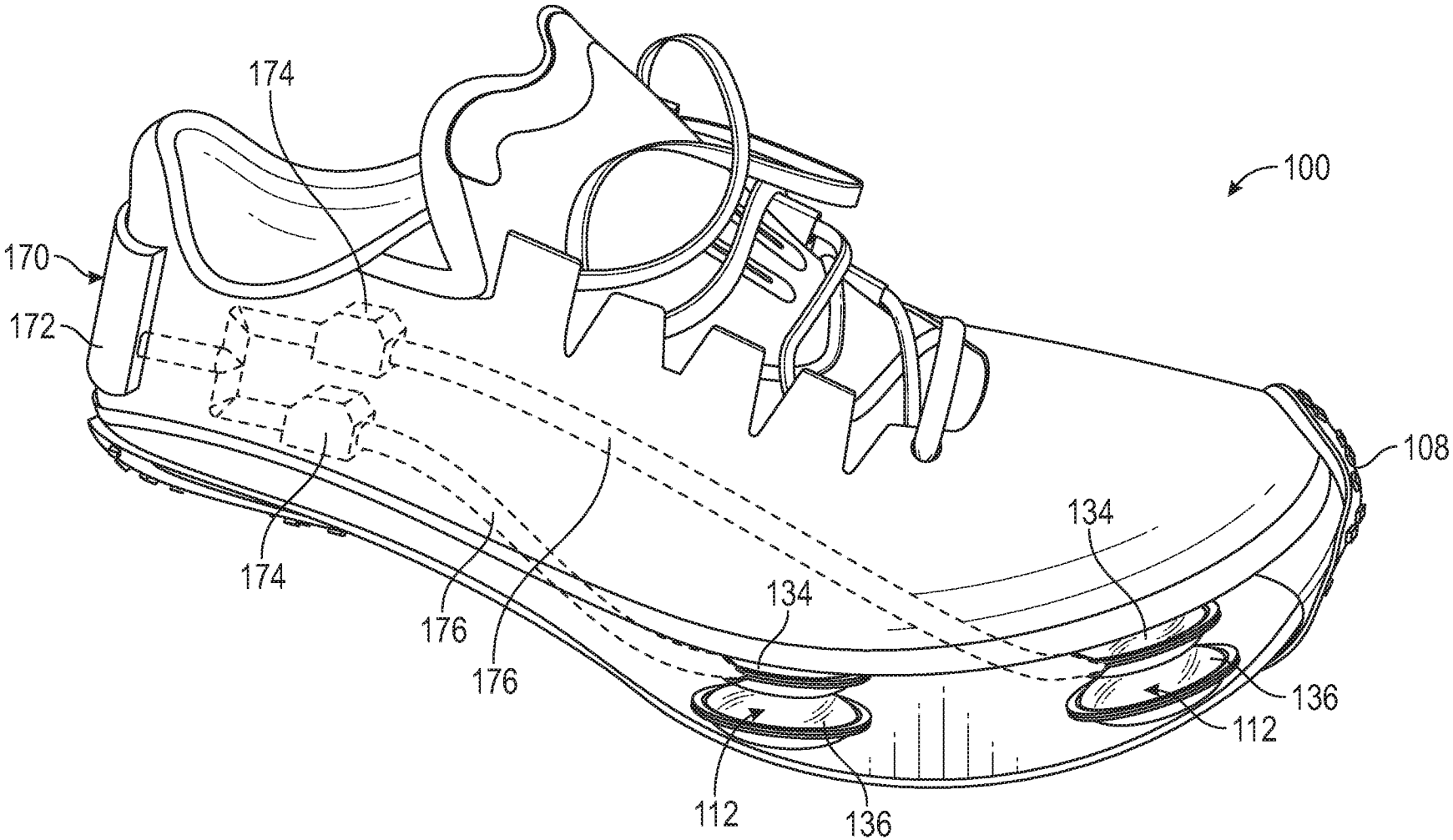
FIG. 6 illustrates a lateral side view of an exemplary right article of footwear that incorporate adaptive, fluid-filled bladder elements.
Figure 7:
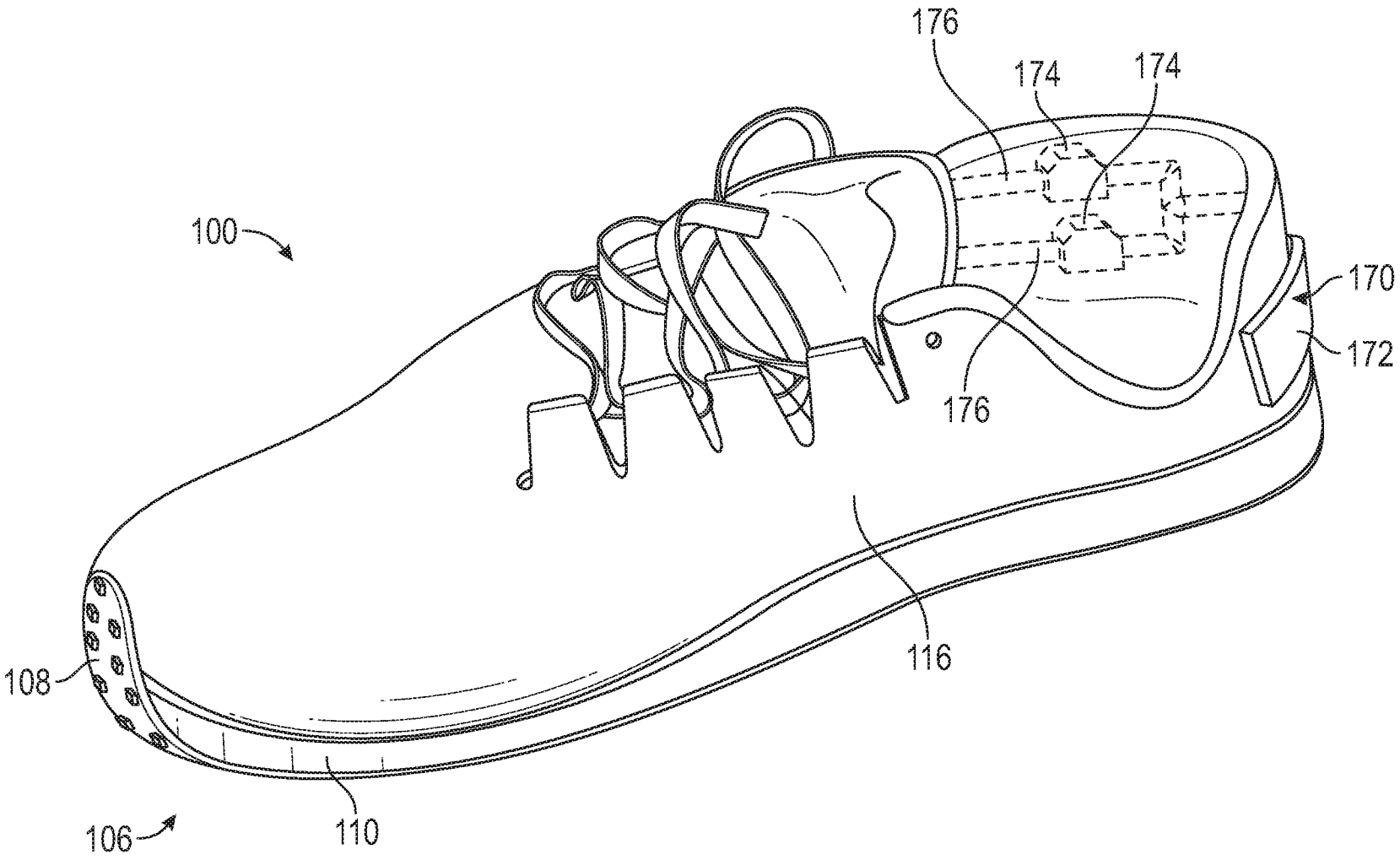
FIG. 7 illustrates a medial side view of an exemplary right article of footwear that incorporate adaptive, fluid-filled bladder elements.

FIGS. 5 and 6 illustrates a right article of footwear 100 that includes the adaptive-height midsole structure 110 with a pair of bladder systems 112 on the lateral side 114. FIG. 7 illustrates the right article of footwear 100 from the left side. As shown in FIGS. 5 and 6, a plurality of bladder systems can be provided to achieve a desired banking angle. In FIGS. 5 and 6, a first bladder system is positioned in the forefoot region 122 and a second bladder system is positioned at least partially in a midfoot region 120.

The bladder systems 112 illustrated in FIGS. 5 and 6 comprise a pair of fluid-filled bladder elements 134, 136 that are stacked with bladder element 134 on top of bladder element 136. Each of the bladder elements defines a respective internal cavity and for each bladder system, respective bladder elements can be fluidly connected, such that fluid from the bladder element 134 can flow freely to bladder 136, and vice versa.

Figure 8:
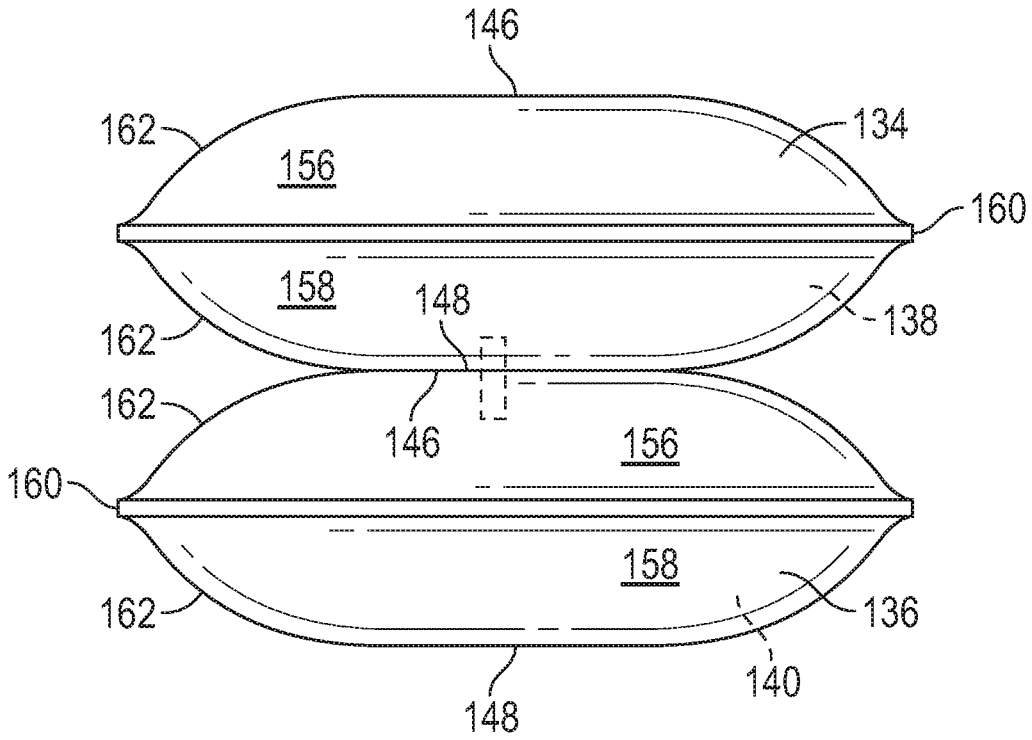
FIG. 8 illustrates an exemplary arrangement of fluid-filled bladder elements.

Bladder elements 134, 136 can be formed in various manners. For example, as shown in FIG. 8, each bladder element can be formed by securing a first polymeric sheet 156 to a second polymeric sheet 158 to define the respective internal cavity. First and second polymeric sheets 156, 158 are substantially impermeable to the fluid to be contained within their cavities. First polymeric sheet 156 and second polymeric sheet 158 can be coupled together (e.g., welded) around their respective peripheries to form a peripheral bond 160.

As shown in FIG. 8, first polymeric sheet 156 forms the upper peripheral surface 146 and a portion of a sidewall 162 of bladder element 134, and second polymeric sheet 158 forms the lower peripheral surface 148 and another portion of sidewall 162 of bladder element 134. Peripheral bond 160 can be located at a midpoint of sidewall 162 or, alternately, positioned closer to the lower peripheral surface 148 or the upper peripheral surface 146. As noted above, bladder elements 134, 136 can be fluidly connected, such as by an internal passageway 164 which interconnects their internal cavities 138, 140.

Bladder elements can be thermoformed in a mold assembly, with the first and second polymeric sheets 156, 158 being vacuum formed to the shape of the mold assembly during the thermoforming process. The sheets can be bonded to one another to form the peripheral bond by compression during the thermoforming process and fluid can be provided to the internal cavity of the bladder element through a fill tube. After inflation of the bladder element, the fill tube can be plugged and subsequently trimmed prior to assembling the sole structure or article of footwear.

In addition to the peripheral bond 160, first and second polymeric sheets 156, 158 can be welded together at one or more internal areas to achieve a desired shape and configuration of the bladder element.

It should be understood that the structure of bladder elements described herein can vary. Although illustrated herein as a double-stacked pair of generally circular bladder elements in FIGS. 5 and 6, the bladder elements can take any convenient shape. For example, a single bladder element can be used instead of a double-stacked pair. In addition, the bladder elements may be other shapes, such as rectangular or oval. In addition, instead of a pair of bladder elements, a single bladder element (i.e., a bladder element with a single cavity) can be provided that extends from a forefoot region to a midfoot region, or elsewhere along the article as desired. Similarly, instead of a bladder element with a consistent height across its width, a bladder element that varies in height can be provided, such as a rectangular valve that tapers to a shorter height on one side. Thus, for example, a wedge-like bladder element can be provided to support the sole structure across the width of the article of footwear.

As shown herein, a fluid control system 170 can be configured to inflate and deflate the bladder systems 112 to achieve a desired banking angle 128. Fluid control system can include one or more reservoirs 172, one or more valves 174 that control the flow of fluid from the reservoir to the bladder systems, and one or more fluid lines 176 through which the fluid can flow between the reservoir 172 and bladder systems 112. As shown in FIGS. 5 and 6, for example, each bladder system can have a separate valve between the reservoir(s) and the respective bladder system. In addition, if desired, each valve can be independently operable. Thus, for example, inflation (or deflation) in a first bladder system can operate independently of inflation (or deflation) in a second bladder system.

Figure 9:
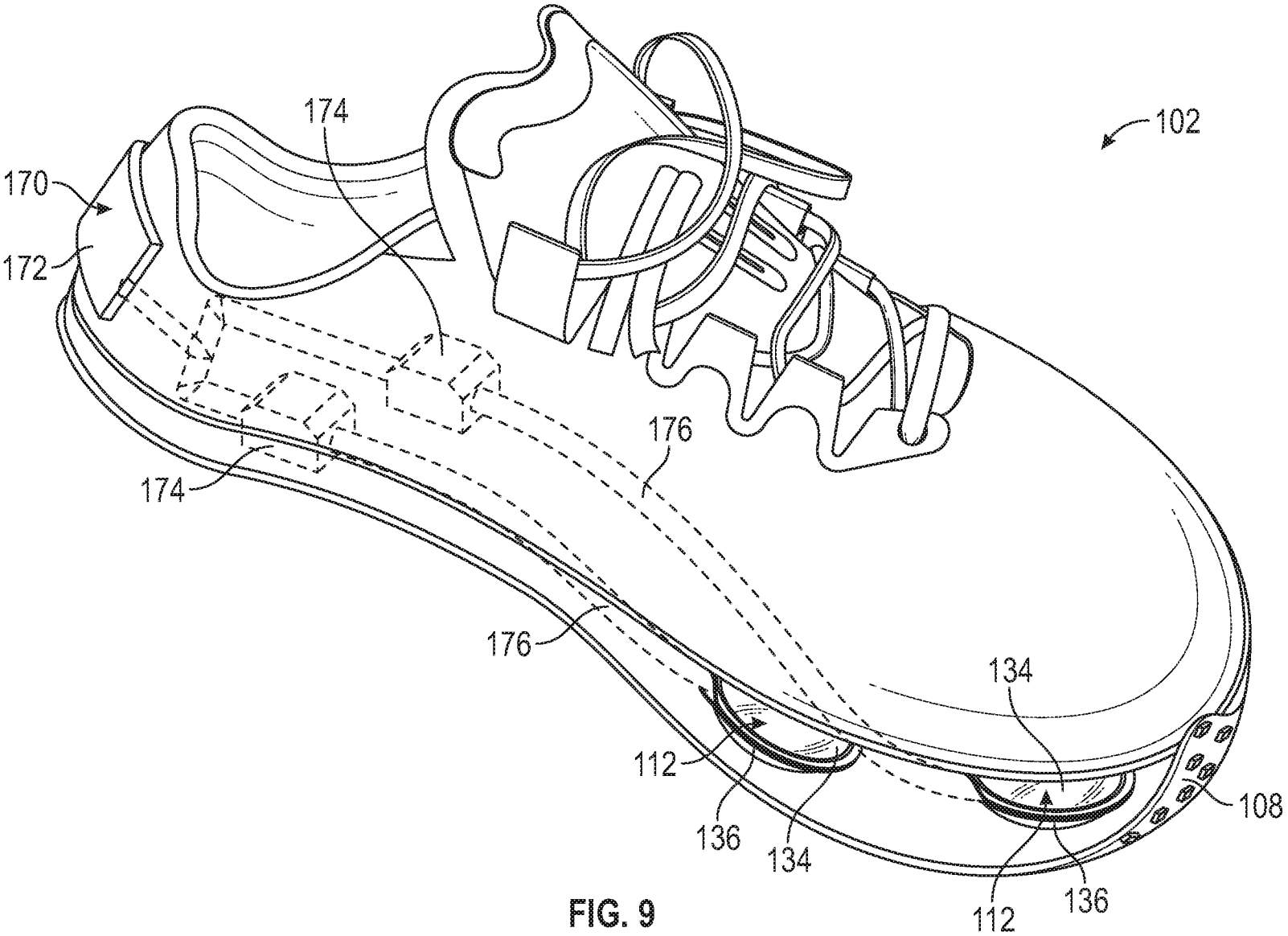
FIG. 9 illustrates a medial side view of an exemplary left article of footwear that incorporate adaptive, fluid-filled bladder elements.
Figure 10:
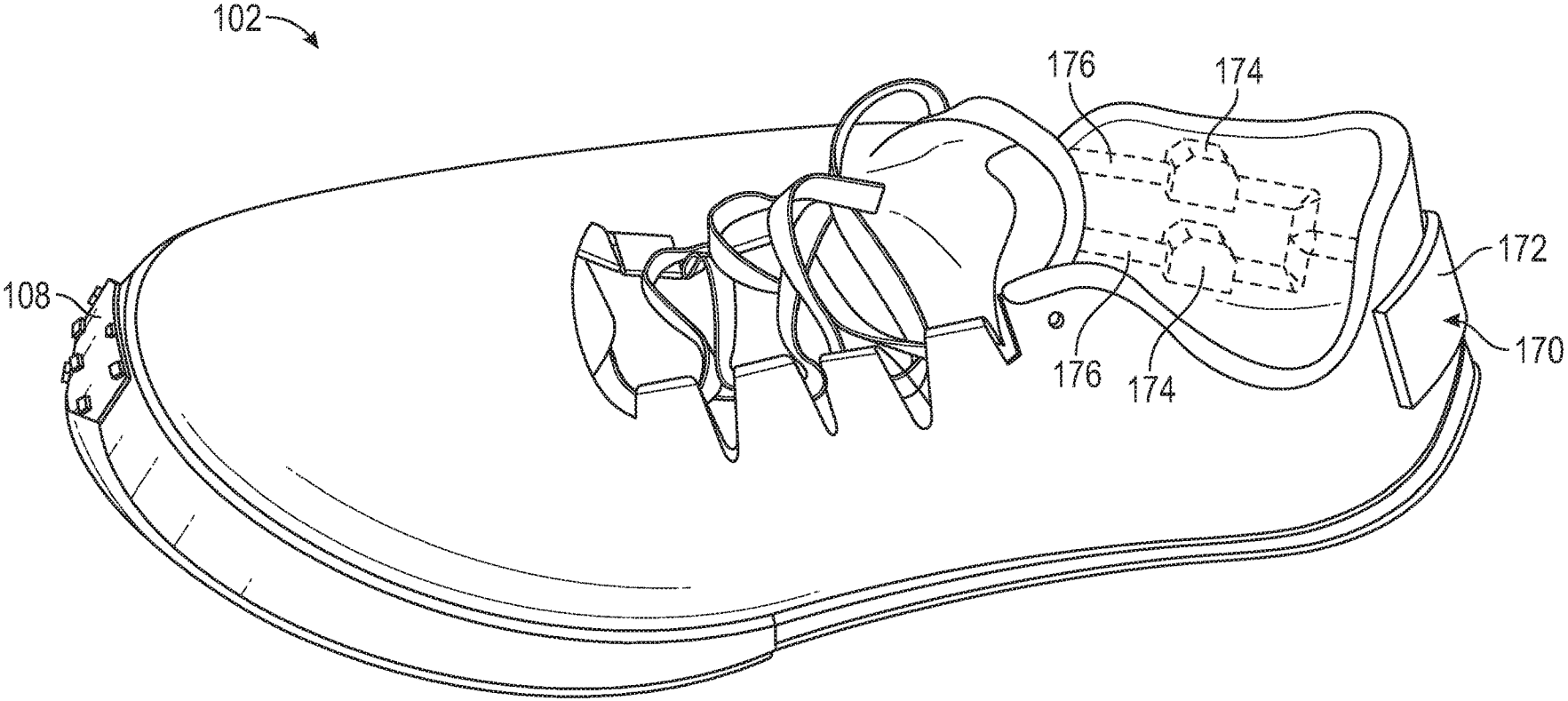
FIG. 10 illustrates a lateral side view of an exemplary left article of footwear that incorporate adaptive, fluid-filled bladder elements.

FIGS. 9 and 10 illustrate the left article of footwear 102, which can have a similar arrangement to that of the right article of footwear 100. Since the bladder system 112 of the left article 102 is on the medial side, rather than the lateral side, the fluid control system 170 can be either arranged in a similar manner as the right article (i.e., on the bladder system side) or on a lateral side, if desired.

Although the reservoir is indicated as being attached to a heel region of the articles and the valves and fluid lines indicated as being positioned on the bladder system side (e.g., lateral side 114 for right article 100 and medial side for left article 102), it should be understood that these components can be positioned and secured at other locations on the articles of footwear. Thus, for example, the reservoir can be positioned closer to the bladder systems (such as adjacent a lacing structure or toe portion of the articles) to reduce the amount of fluid tubing required by the system. In addition, any of these components can be provided externally (i.e., on an outside of the upper) and/or internally (e.g. within the upper and/or sole structure). In some embodiments, a volume of the reservoir 172 and its associated tubing is of sufficient size to contain all the fluid in the system, such that the bladder systems 112 can be completely evacuated.

Fluid can be moved between the reservoir 172 and bladder systems 112 in a variety of manners, including any combination of valves and pumps. In one embodiment, the reservoir system is biased to expel fluid out of the reservoir, such that the opening of one or more valves between the reservoir and bladder systems (without any other external forces) causes fluid in the reservoir to be delivered to the bladder system.

Figure 11A:
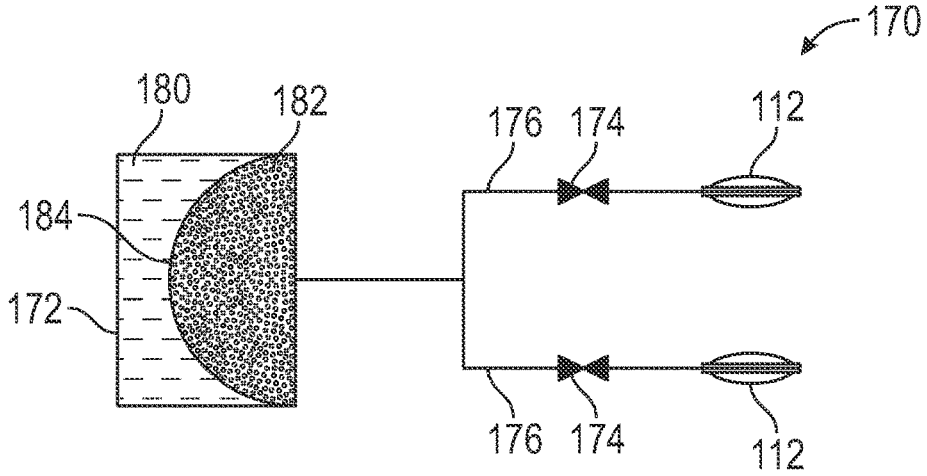
FIGS. 11A-11C illustrate exemplary states of a fluid control system and bladder system.
Figure 11B:
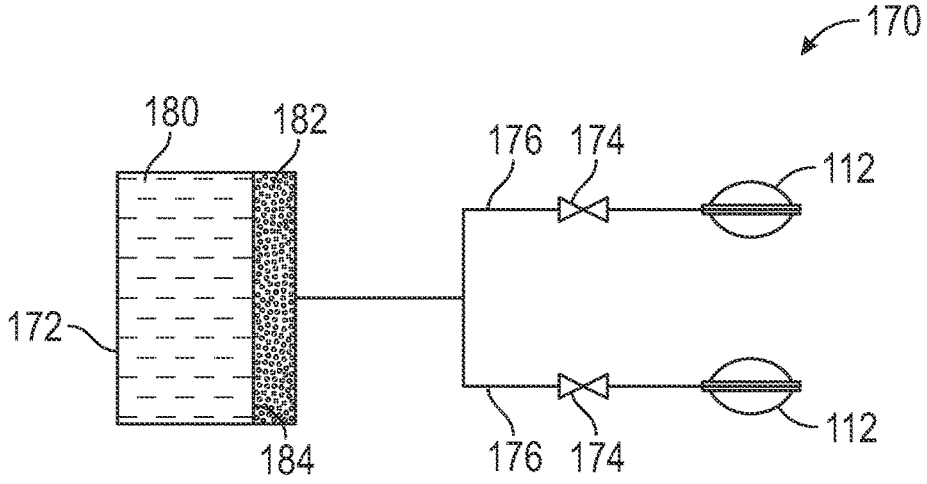
Figure 11C:
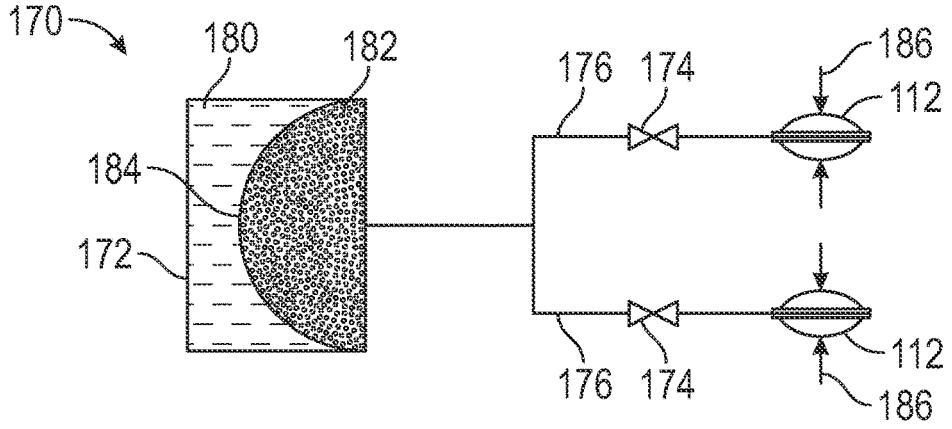

For example, FIGS. 11A-11C show a schematic operation of a reservoir 172 that is biased to expel fluid (e.g., air) from the reservoir. Reservoir 172 comprises a first chamber 180, a second chamber 182, and an elastic member 184 (e.g., a film) separating the first and second chambers 180, 182. The first chamber 180 can comprise a first fluid (e.g., water) and the second chamber can be in fluid communication with a second fluid (e.g., air) which is the pressurizing fluid for the bladder systems.

FIG. 11A illustrates the reservoir 172 in a charged state, in which air from the bladder systems 112 is contained within the reservoir 172 and the valves 174 are closed. As shown in FIG. 11B, once the valves are open, the pressurized water pushes on the elastic member 184, forcing the second fluid (e.g., air) out of the reservoir 172 and into the bladder systems 112. Once the second fluid is expelled from the reservoir, the valves can close, trapping the second fluid in the bladder systems 112. The amount of the second fluid that moves to the bladder systems 112 (and, therefore, the amount of inflation of the bladder systems 112) depends on the amount of time that the valves 174 are open. Thus, opening the valves for a short time allows for a small amount of inflation in the bladder systems, while opening the valves for a longer time allows for a larger amount of inflation in the bladder systems.

To reduce an amount of inflation in the bladder systems 112, the second fluid (e.g., air) must be forced out of the bladder systems 112 while the valves are open. Thus, for example, the valve(s) can be opened for a brief period during a foot strike (i.e., when the article of footwear contacts the ground during running and a weight of the wearer is exerted on the article of footwear) in which a force 186 is applied to the bladder systems 112 causing the fluid to be forced from the bladder systems 112 into the reservoir 172.

The valves 174 can be any suitable valve that can operate to control the flow of fluid between the reservoir 172 and the bladder systems 112. For example, if a maximum pressure within the system is 50 psi, the selected valve should be suitable for control the flow rate of fluids at that pressure. A low profile, low weight design is preferable since the valves are mounted and/or secured to an article of footwear. In some embodiments, the valve can be controlled by voltage, current, or pulse width modulation (PWM) signals.

Figure 12:
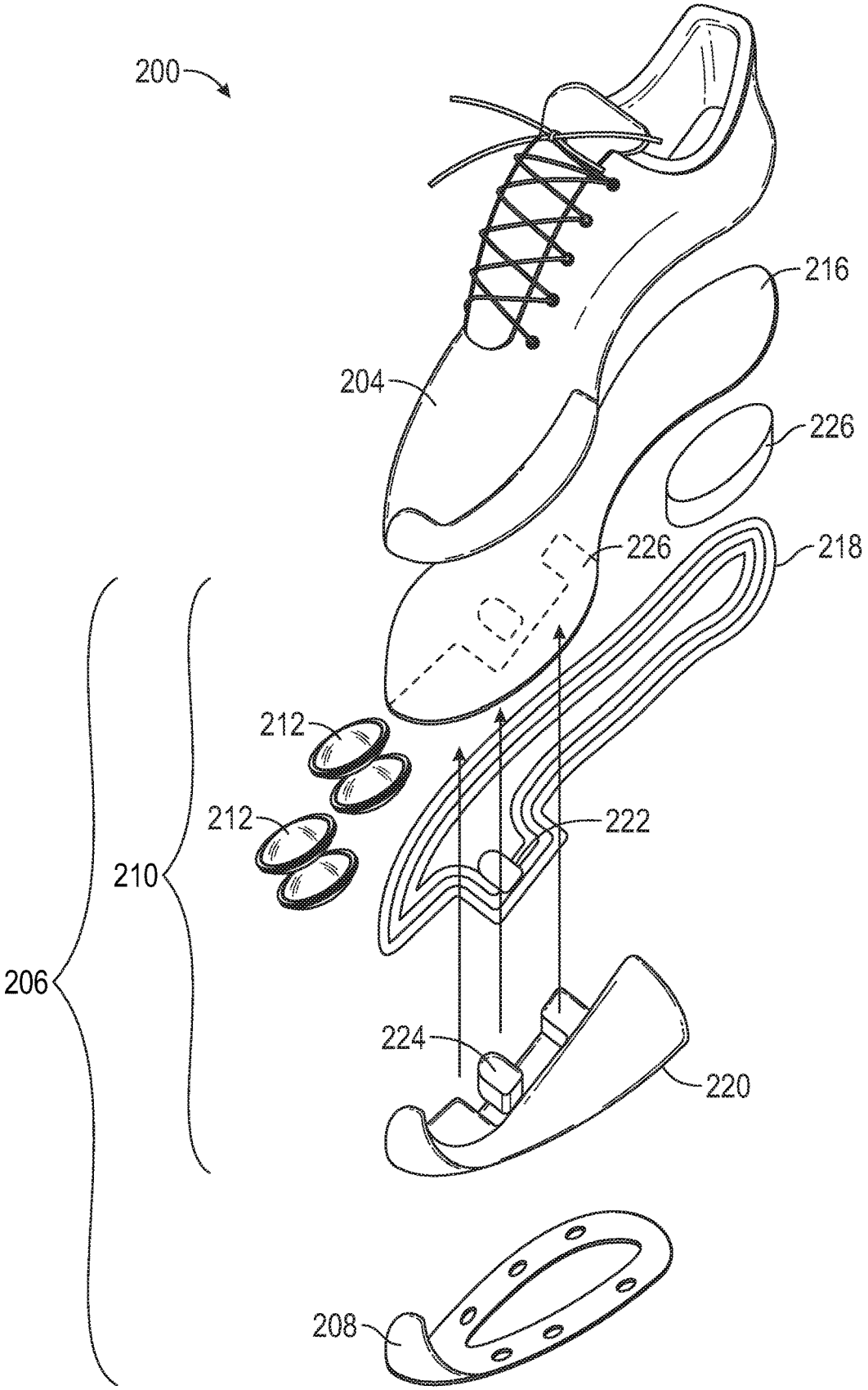
FIG. 12 illustrates an exploded view of an exemplary article of footwear.

FIG. 12 illustrates an exploded view of an exemplary article of footwear 200 with an upper 204 coupled to a sole structure 206. Each sole structure 206 includes an outsole 208 and an adaptive-height midsole structure 210 with a plurality of bladder systems 212.

Midsole structure 210 comprises a stiffening plate 216 (or midsole), a banking plate 218, and an anchor plate 220. The stiffening plate 216 is secured to the upper 204 and banking plate 218 is moveable relative to stiffening plate 216. Banking plate 218 is secured to the sole structure 206 by anchor plate 220, which is secured to the stiffening plate 216. In particular, banking plate 218 has one or more apertures 222 that engage with one or more respective projections 224 on the anchor plate 220, and the upper surface of the anchor plate 220 (including the upper surface of the one or more projections 224) is secured to the stiffening plate at a lower portion 226 of the stiffening plate 216. The one or more apertures can be openings, slits, and/or gaps in the banking plate that are completely or partially surrounded by other portions of the banking plate. Preferably, the amount of circumscription of the aperture(s) is sufficient to receive the one or more projections and at least partially restrict, individually or collectively, movement of the banking plate in one or more directions relative to the anchor plate.

Because the bladder systems 212 are secured between the stiffening plate 216 and the banking plate 218, when they inflate and deflate, the move the stiffening plate 216 and banking plate 218 further apart and closer together, respectively. Because the banking plate 218 is pivotably mounted to the anchor plate 220 in the forefoot region (e.g., by one or more projections), a range of motion is possible. Banking plate 218 can be coupled to the sole structure 206 in the heel region. For example, in one embodiment, a heel member 226 (e.g., foam) is coupled to a bottom surface of the stiffening plate and a respective heel portion of banking plate 218 can be secured to the heel member 226. In this manner, banking plate 218 is secured (e.g., fixed) to a structure at a heel region but moveable (e.g., pivotable) in a forefoot region of the article.

Outsole 208 can be secured to a lower surface of the adaptive-height midsole structure, such as over a lower surface of the anchor plate 220. In some embodiments, outsole 208 can also extend over a portion of the banking plate 218. If covering both anchor plate and banking plate, the outsole can be formed of a material that has sufficient elasticity to permit the amount of flexing required due to relative movement of the anchor and banking plates. Outsole 208 can be formed, for example, of a durable, wear resistant material that includes texturing or other features to improve traction, such as rubber, phylon, phyllite, thermoplastic polyurethane, and other suitable materials.

Various materials are possible for the construction of the midsole structure. In some embodiments, the stiffening and banking plates can be formed from a composite material, such as carbon fiber. The anchor plate can be formed from similar materials, or in other embodiments, the anchor plate can be formed from plastics (such as nylon) or other suitably stiff and durable materials.

Figure 13:
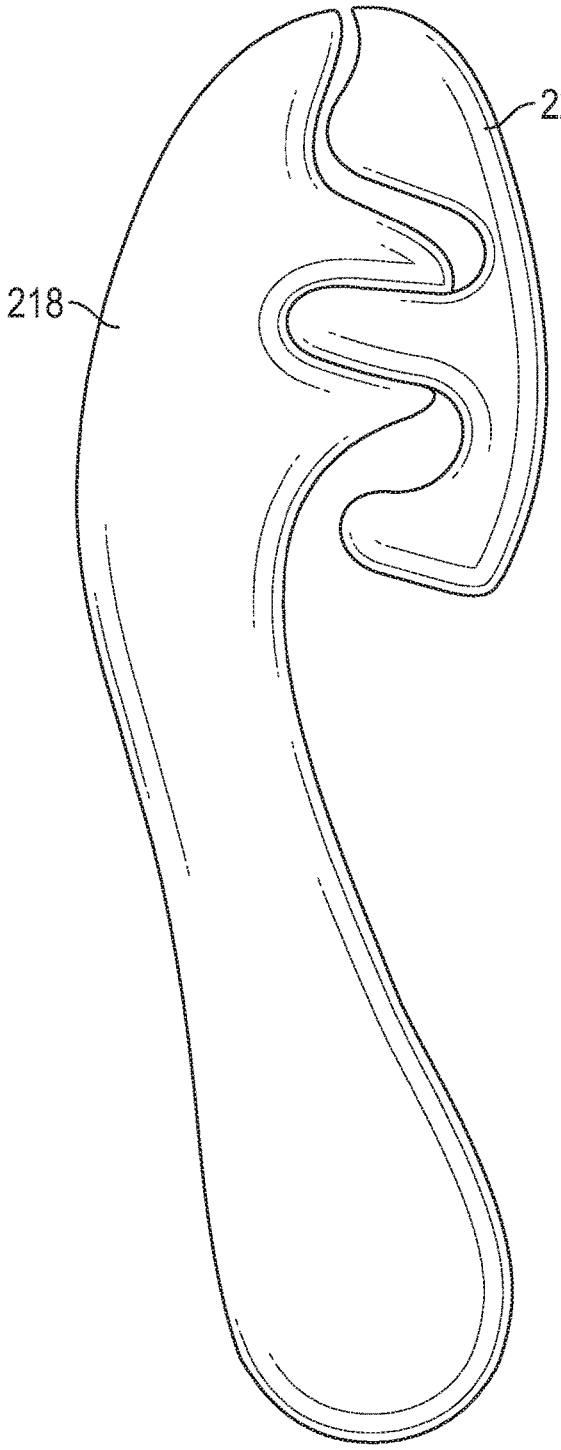
FIG. 13 illustrates a bottom view of an exemplary anchor plate engaged with an exemplary banking plate of a right article of footwear.
Figure 14:
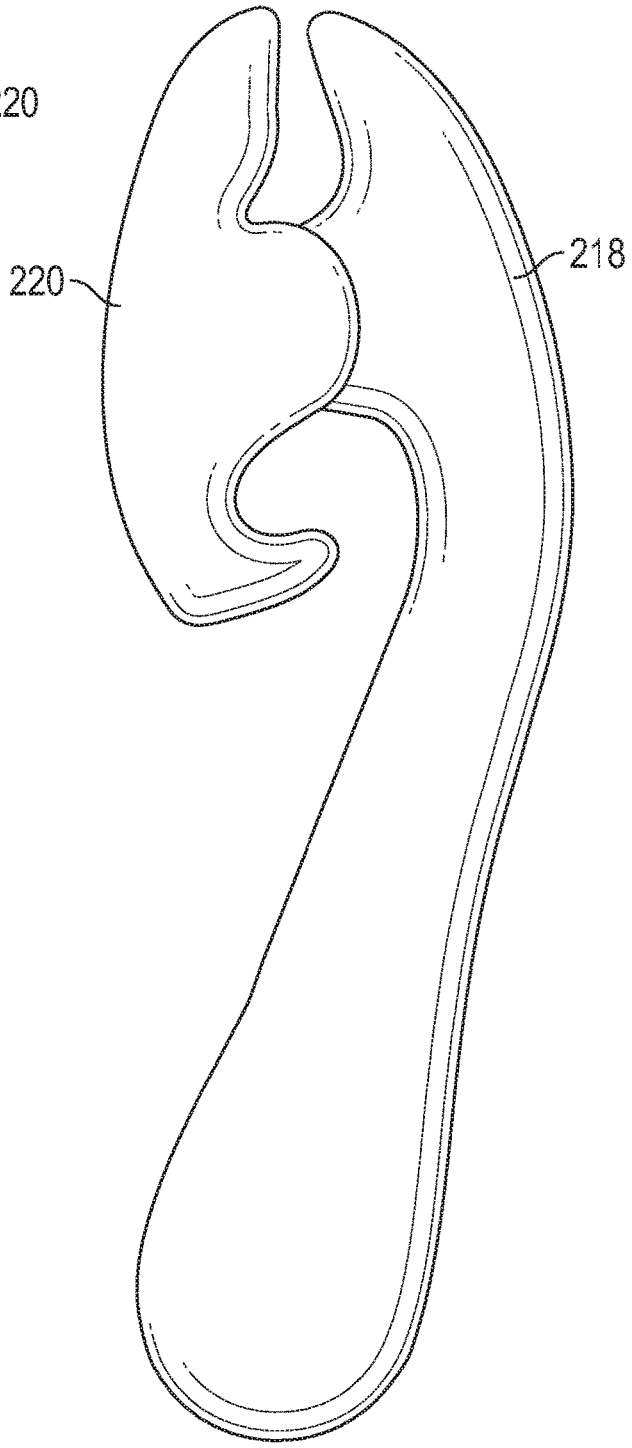
FIG. 14 illustrates a bottom view of an exemplary anchor plate engaged with an exemplary banking plate of a left article of footwear.
Figure 15:
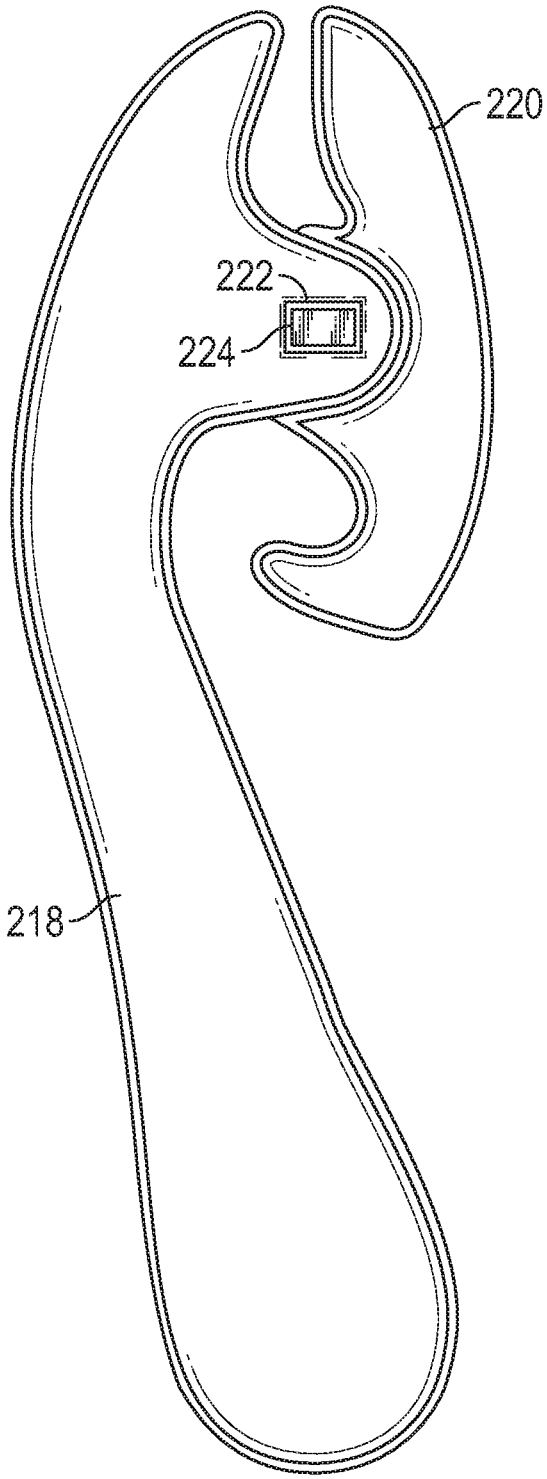
FIG. 15 illustrates a top view of an exemplary anchor plate engaged with an exemplary banking plate of a left article of footwear.
Figure 16:
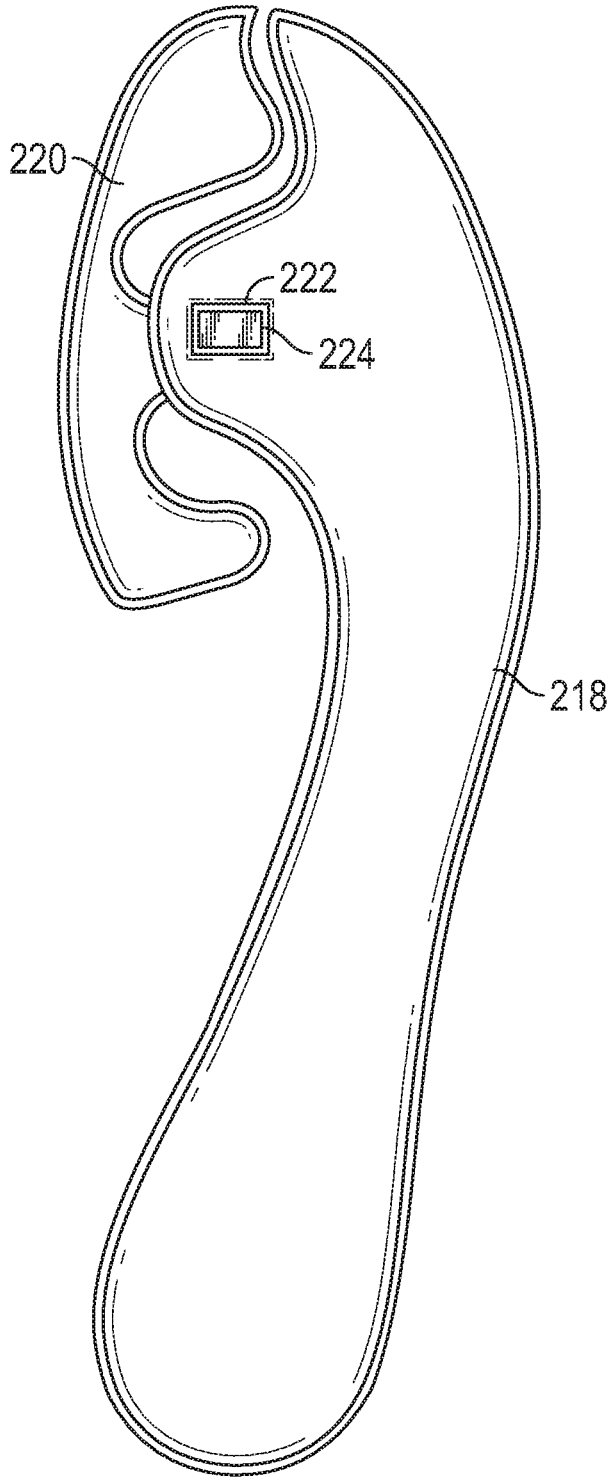
FIG. 16 illustrates a top view of an exemplary anchor plate engaged with an exemplary banking plate of a right article of footwear.

FIG. 13 shows a bottom view of a banking plate 218 and an anchor plate 220 for a right article of footwear and FIG. 14 shows a bottom view of a banking plate 218 and an anchor plate 220. FIGS. 15 and 16 shows the top views, respectively, of FIGS. 13 and 14. As discussed above with respect to FIG. 12, one or more openings 222 in the banking plates 218 engage with projection(s) 224 in a respective anchor plate 220 to secure the banking plate 218 to the midsole structure. FIGS. 13-16 illustrate this engagement. In addition, as shown in FIGS. 13-16, it should be understood that banking plates and anchor plates may have different shapes for the right and left articles of footwear, due to the shape of the articles and anatomy of the foot.

Figure 17:
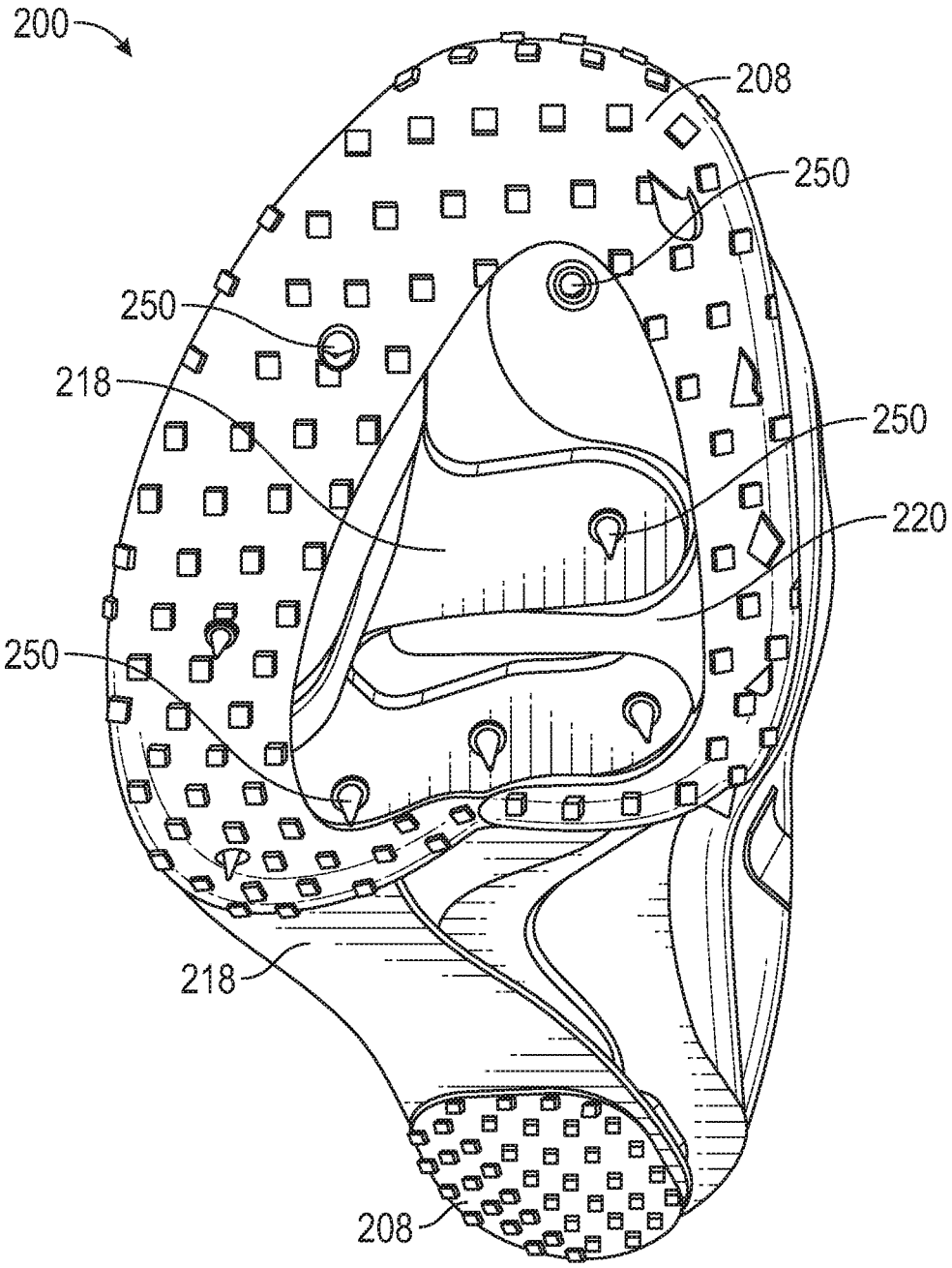
FIG. 17 illustrates a bottom perspective view of an exemplary right article of footwear.

FIG. 17 illustrates a bottom view of an exemplary article of footwear with an adaptive-height midsole structure. As shown in FIG. 17, the outsole 208 can cover a heel region and portions of the banking plate 218 and anchor plate 220. In addition, one or more spikes 250 can be provided in the sole structure. Spikes 250 can extend through one or more portions of the sole structure, including the anchor plate, banking plate, and outsole.

Figure 18:
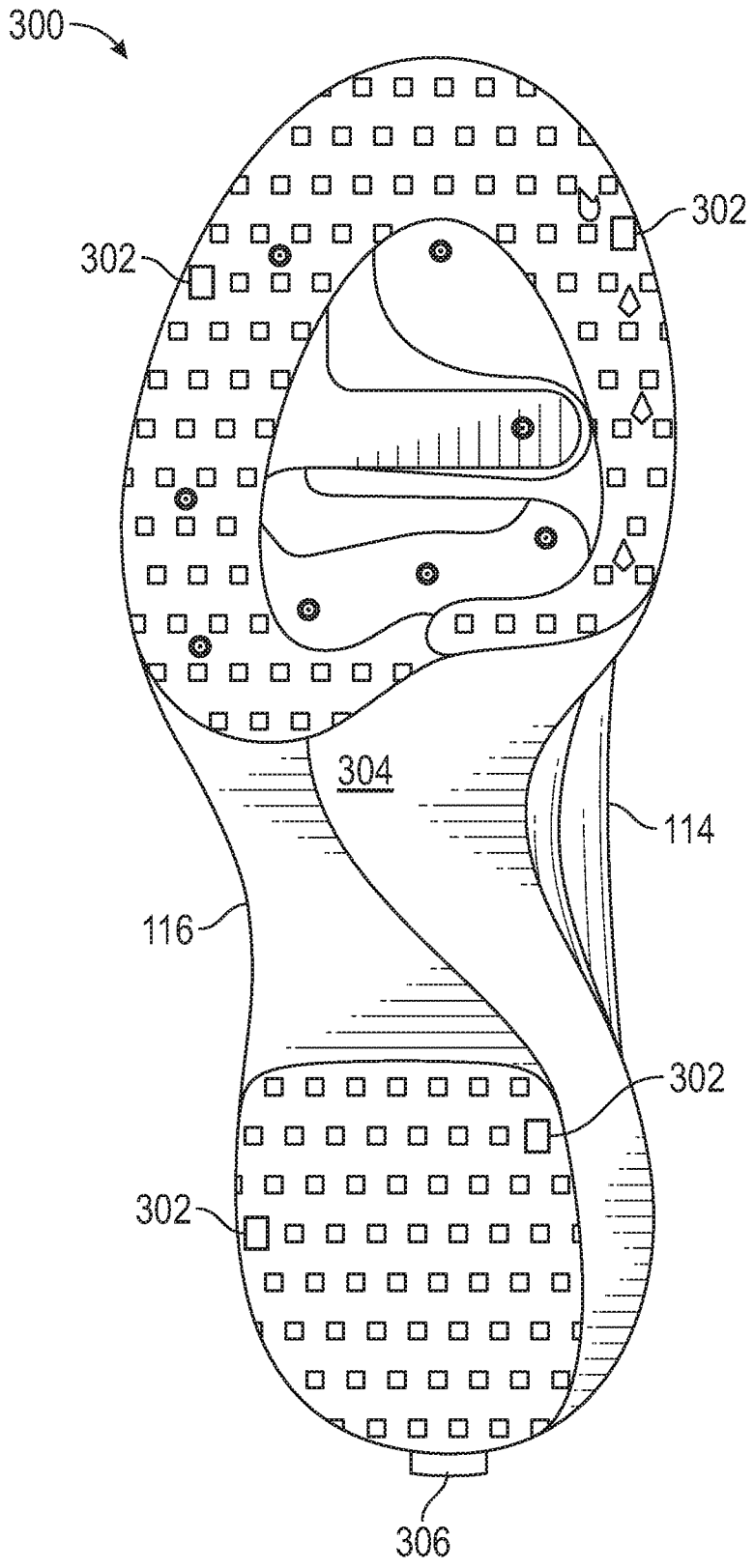
FIG. 18 illustrates a schematic view of an exemplary article of footwear having one or more sensors.

Timing of inflation and deflation can be achieved in a variety of manners, both internal and external to the articles footwear themselves. For example, one or more sensors can be provided on the article of footwear that are capable of sensing a change in movement or running style, such as a transition from straight running to leaning into a turn. FIG. 18 illustrates various sensors that can be used, alone or in combination with each other, to identify forces that indicate a current and/or future change in movement.

For example, as shown in FIG. 18 an article of footwear 300 can include one or more sensors 302 on a bottom surface 304. For example, one or more force sensors can be provided to identify changes on forces exerted on the article of footwear, which can, in turn, identify changes in direction of the runner. For example, as a runner begins to turn the runner will begin to lean into the turn which results in different forces—compared to straight running—being applied to the article of footwear by the runner and the ground.

In some embodiments, sensors can be provided on both the lateral side 114 and medial side 116 so that differences between the lateral and medial side forces can be used to indicate changes in running style/direction. Other sensors can be used, including, for example, one or more gyroscopes or accelerometers 306 provided on the article to identify changes in a running direction. Although placement locations of the one or more gyroscopes or accelerometers can vary, one advantageous location for such sensors may be the heel as shown in FIG. 18.

In other embodiments, sensors can be positioned on or within the bladder elements themselves. For example, pressure sensors at different locations in the bladder elements may be used to identify changes in direction.

In addition, as noted above, external controls (i.e., those not on the article itself) can be used to actuate the valves of a fluid control system can be provided. For example, changes in inflation levels can be made directly by the user, by a determined location of the user (e.g., though position-locating systems such as GPS), and/or based on a predetermined distance or timing. For example, a user may know a particular speed at which they run a distance on a track and the fluid control system can be set up to adjust inflation levels accordingly.

Figure 19:
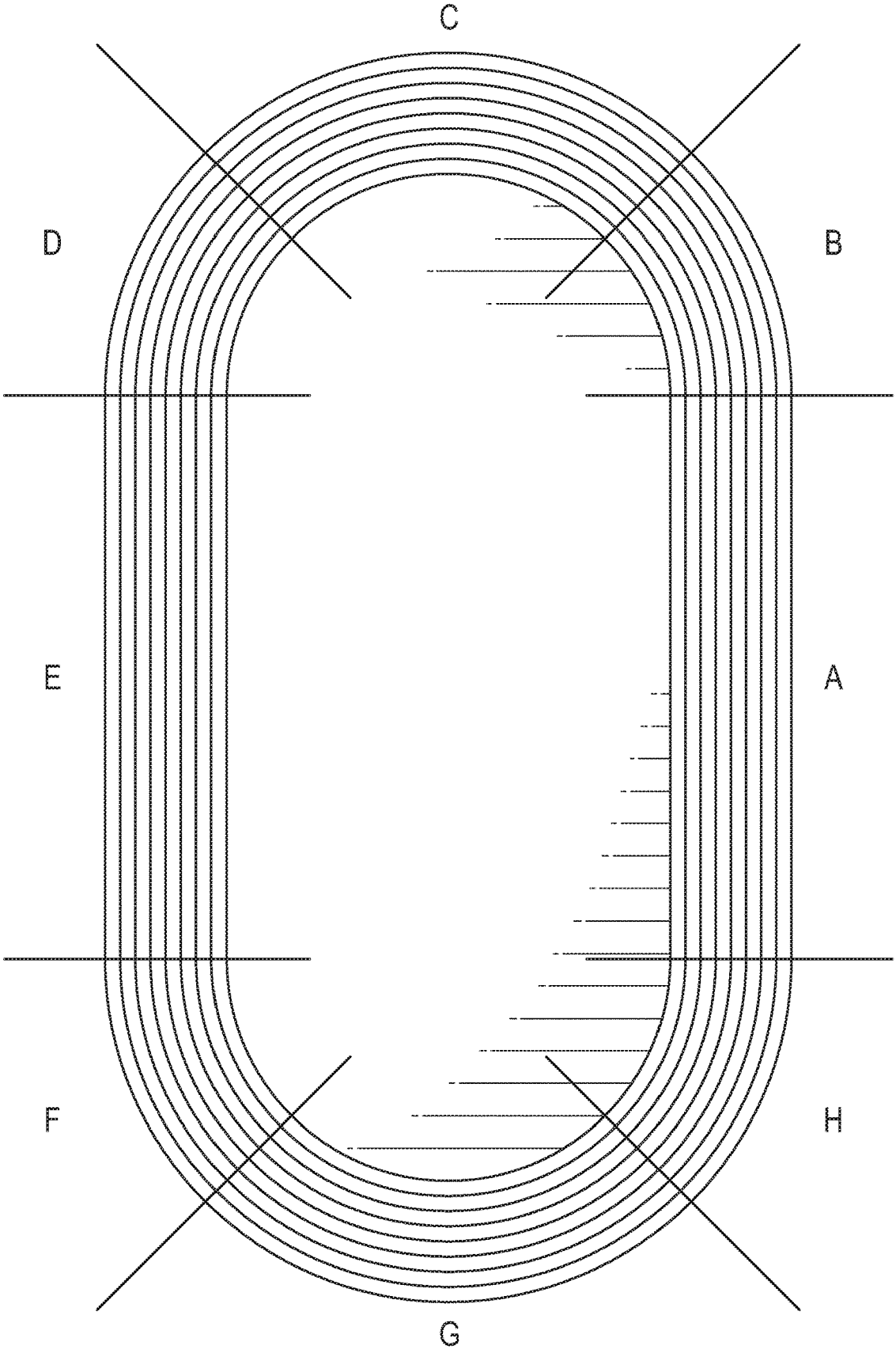
FIG. 19 illustrates a schematic view of a track with different regions.
Figure 20:
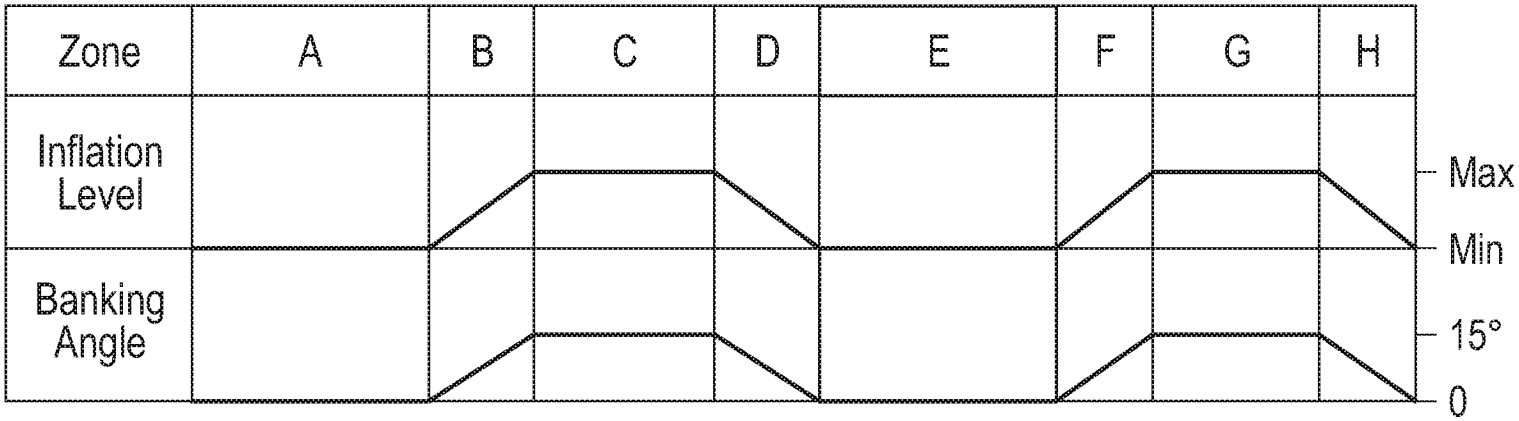
FIG. 20 illustrates an exemplary change in banking angles and inflation levels as a runner enters and leaves the different regions shown in FIG. 19.

FIG. 19 discloses a track and identifies region A, B, C, D, E, F, G, and H on the track. As shown in FIG. 20, it may be desirable to alter an amount of inflation in the bladder systems, and, in turn, alter a banking angle of the article of footwear, as the wearer moves from one region to another. Thus, for example, in region A, a runner would be moving generally straight (i.e., in a forward direction) on the track. Thus, it may be desirable to maintain the level of inflation at a minimum (i.e., the uninflated condition), providing a banking angle of 0 degrees. However, as the runner transitions to region B, some amount of inflation and an increased banking angle may be desirable. As shown in FIG. 20, the banking angle changes from a minimum angle (e.g., 0 degrees) to a maximum angle (e.g., 15 degrees) between entering the region B and approaching and/or entering region C. Region C is the portion of the track with the smallest curvature and, as such, the maximum banking angle (and maximum inflation) may be desirable in this region.

Upon entering region D, it may be desirable to reduce the banking angle, so the flow control system begins to reduce the amount of inflation in the bladder systems until the runner hits region E, which is another straight portion of the track. As the runner leaves region E and enters regions F, G, and H, the same increase and decreases as discussed above with respect to regions B, C, and D may be desirable.

As discussed above, the timing of inflation and deflation can be achieved in a variety of manners, both internal and external to the articles footwear themselves. To open and close the valves a signal can be received from a control unit 310 associated with and/or integrated with one or more of the sensors. The control unit can be configured to receive signals from any of the sensors on the article as well as from remote sources, such as smartphones or other remote signaling devices. If the control system is configured to receive information from remote sources, the control system can include an antenna that can wirelessly receive such information.

Figure 21:
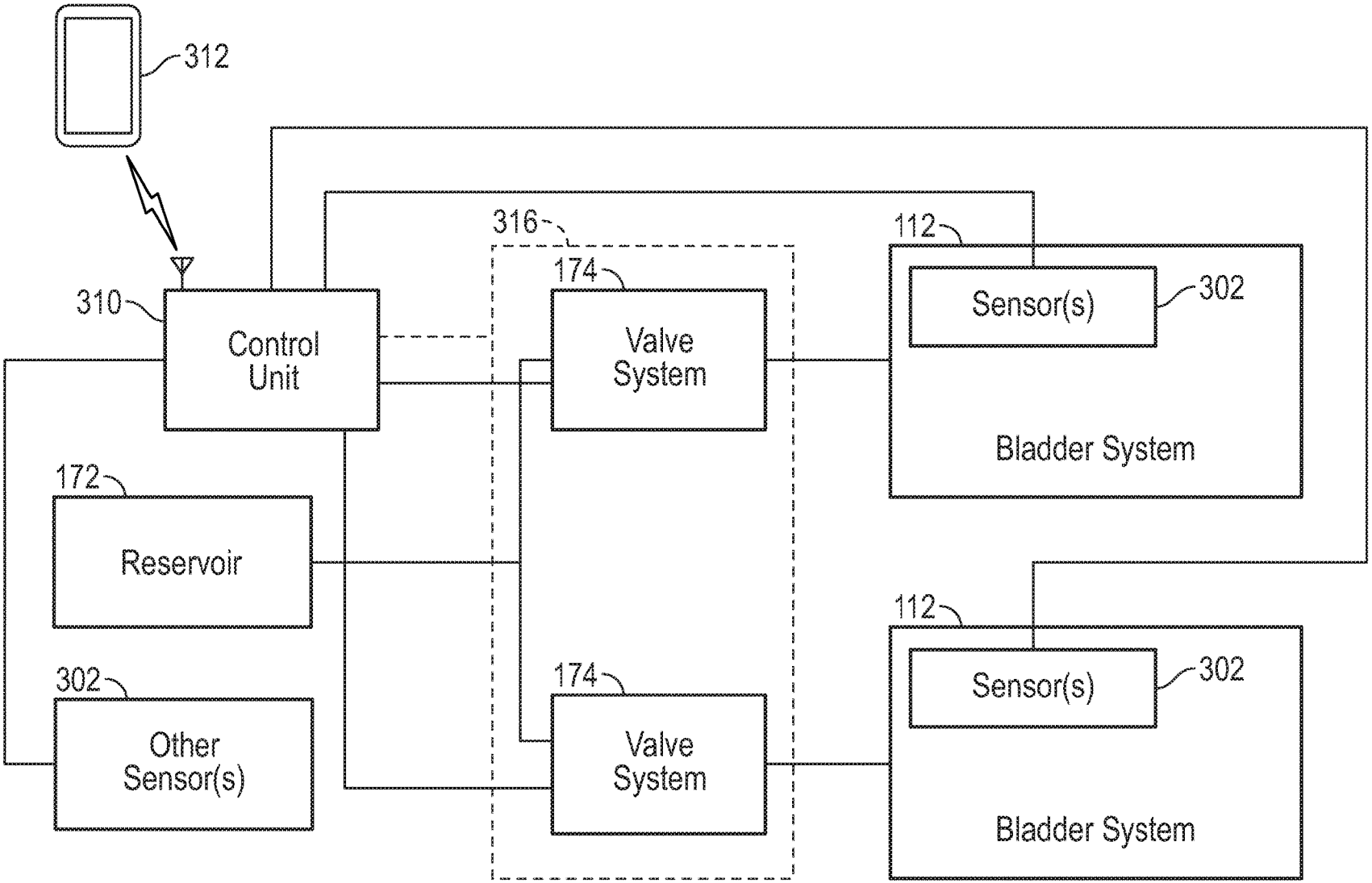
FIG. 21 illustrates a schematic embodiment of a fluid control system.

FIG. 21 illustrates a schematic embodiment of a fluid control system that further includes a control unit 310 that is capable of receiving information from one or more sensors 302 and/or information from a remote device 312 and, based on that information, can send signals to the valve(s) 174 (or to a single valve 316, shown optionally in FIG. 21) to direct the valve(s) to open or close to vary an amount of inflation in the bladder systems 112.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

We claim:

1. An article of footwear comprising:

an upper; and a sole structure, the sole structure comprising:

a midsole secured to the upper;

an anchor plate secured to at least a portion of the midsole, the anchor plate having at least one projection;

a banking plate positioned between the midsole and the anchor plate, the banking plate having at least one aperture into which the at least one projection extends; and at least one bladder system having at least one cavity, the at least one bladder system being disposed between the midsole and the banking plate, the at least one bladder system being configured to receive a fluid in the at least one cavity, the at least one bladder system being secured to a bottom surface of the midsole and a top surface of the banking plate, wherein the at least one bladder system is configured such that increasing an amount of the fluid in the at least one bladder system changes the at least one bladder system from an uninflated state to an inflated state, wherein the banking plate and the midsole have a first relative orientation when the at least one bladder system is in the uninflated state and a second relative orientation when the at least one bladder system is in the inflated state, the first and second relative orientations being different, and wherein the at least one bladder system is positioned on a lateral side or a medial side of the article of footwear, and a banking angle is formed between the banking plate and the anchor plate when the at least one bladder system is in the inflated state.

2. The article of footwear of claim 1, further comprising a fluid control system that can adjust an amount of inflation of the at least one bladder system, the fluid control system comprising:

at least one reservoir;

at least one fluid line extending from the at least one reservoir to the at least one bladder system; and at least one valve positioned between the at least one reservoir and the at least one bladder system, wherein the at least one valve has a closed position in which the fluid is prevented from flowing between the at least one reservoir and the at least one bladder system, and an open position in which the fluid can flow between the at least one reservoir and the at least one bladder system.

3. The article of footwear of claim 2, wherein the at least one bladder system comprises a plurality of bladder systems and each of the plurality of bladder systems have a different one of the at least one valves positioned between the at least one reservoir and a respective one of the plurality of bladder systems.

4. The article of footwear of claim 1, wherein the article of footwear is a right article of a pair of articles of footwear and the at least one bladder system is positioned on the lateral side of the right article.

5. The article of footwear of claim 1, wherein the article of footwear is a left article of a pair of articles of footwear and the at least one bladder system is positioned on the medial side of the left article.

6. The article of footwear of claim 1, wherein the banking plate is secured to the midsole at a heel region of the article of footwear to restrict movement between the midsole and the banking plate, the at least one bladder system is positioned in a forefoot region and/or a midfoot region of the article of footwear, and the banking plate is moveable relative to the midsole in the forefoot region and/or midfoot region.

7. The article of footwear of claim 6, further comprising a heel member secured to the banking plate and a bottom surface of the midsole in the heel region, wherein the banking plate is secured to the midsole through the heel member.

8. The article of footwear of claim 7, wherein the heel member is a foam material.

9. The article of footwear of claim 1, wherein the banking angle is greater than 0 degrees and less than 20 degrees.

10. The article of footwear of claim 1, wherein the banking angle is greater than 0 degrees and less than 18 degrees.

11. The article of footwear of claim 1, wherein the banking angle is greater than 0 degrees and less than 15 degrees.

12. The article of footwear of claim 1, wherein the at least one bladder system comprises a first bladder system positioned in a forefoot region of the sole structure and a second bladder system positioned rearward of the first bladder system.

13. The article of footwear of claim 1, wherein the at least one bladder system comprises a first bladder element with a first cavity therein and a second bladder element with a second cavity therein, the first bladder element has a lower surface that is coupled to an upper surface of the second bladder element, and the first bladder element and the second bladder element being fluidly connected so that the fluid can move between the first bladder element and the second bladder element.

14. The article of footwear of claim 1, wherein the sole structure further comprises an outsole secured to at least a portion of the anchor plate and at least a portion of the banking plate, the outsole being formed of a material that can flex to accommodate movement between the anchor plate and banking plate.

15. The article of footwear of claim 1, wherein the anchor plate and banking plate are formed from a composite material.

16. The article of footwear of claim 15, wherein the anchor plate and the banking plate are formed from a carbon fiber composite material.

17. The article of footwear of claim 1, further comprising at least one sensor on the article of footwear, the at least one sensor being configured to identify a change in orientation of the article of footwear and/or a change in forces acting on the article of footwear.

18. The article of footwear of claim 17, wherein the at least one sensor comprises a plurality of force sensors, the plurality of force sensors being positioned on both the lateral and medial sides of the article of footwear.

19. The article of footwear of claim 17, wherein the at least one sensor comprises at least one accelerometer positioned in a heel region of the article of footwear.

* * * * *